US010012444B2

(12) United States Patent
Eplee

(10) Patent No.: US 10,012,444 B2
(45) Date of Patent: Jul. 3, 2018

(54) MULTIPLE OPENING COUNTER-FLOW PLATE EXCHANGER AND METHOD OF MAKING

(75) Inventor: Dustin Eplee, Red Lion, PA (US)

(73) Assignee: Energy Wall, Lancaster, PA (US)

( * ) Notice: Subject to any disclaimer, the term of this patent is extended or adjusted under 35 U.S.C. 154(b) by 500 days.

(21) Appl. No.: 13/426,565

(22) Filed: Mar. 21, 2012

(65) Prior Publication Data

US 2013/0248160 A1 Sep. 26, 2013

(51) Int. Cl.
*F28D 9/00* (2006.01)
*F28D 21/00* (2006.01)

(52) U.S. Cl.
CPC ..... *F28D 9/0025* (2013.01); *F28D 21/0015* (2013.01); *Y10T 29/4935* (2015.01)

(58) Field of Classification Search
CPC ..... F28D 9/0025; F28D 9/0037; F28D 9/062; F28D 21/0015; F28F 3/025; F28F 21/065; F28F 21/66; F28F 21/066
USPC ..... 165/164, 165, 166, DIG. 399
See application file for complete search history.

(56) References Cited

U.S. PATENT DOCUMENTS 4,314,607 A * 2/1982 DesChamps ..... 165/166
4,332,068 A * 6/1982 Melnyk ..... 29/890.03
4,338,998 A * 7/1982 Goloff ..... 165/165
4,384,611 A * 5/1983 Fung ..... 165/166
6,347,527 B1 * 2/2002 Bailey et al. ..... 62/238.7
7,036,560 B1 * 5/2006 Rylewski ..... F28D 9/0025 165/165
7,150,099 B2 * 12/2006 Whittenberger ..... F28D 9/0025 165/165

FOREIGN PATENT DOCUMENTS

WO WO 2009089615 A1 * 7/2009 ..... F24F 3/147

* cited by examiner

*Primary Examiner* — Len Tran
*Assistant Examiner* — Hans Weiland
(74) *Attorney, Agent, or Firm* — Richard K Thomson

(57) ABSTRACT

A multiple opening, counter-flow plate type exchanger is manufactured by repeatedly folding and joining one strip of membrane to form a core composed of a multitude of membrane layers with a plurality of inlet and outlet openings or fluid passageways configured in an alternating counter-flow arrangement. Methods for manufacturing such multiple opening cores are described. An integrated, modular, and stackable plastic manifold that is formed by ultrasonically welding plastic sheet stock is described. Multiple opening cores comprising water-permeable membranes can be used in a variety of applications, including heat and water vapor exchangers. In particular, they can be incorporated into energy recovery ventilators (ERVs) for exchanging heat and water vapor between air streams directed into and out of buildings, automobiles, or other Industrial processes.

25 Claims, 15 Drawing Sheets

MULTIPLE OPENING COUNTER-FLOW PLATE EXCHANGER AND METHOD OF MAKING

FIELD OF THE INVENTION

The present invention relates to multiple opening, continuous fold single membrane plate exchangers and continuous fold single spacer within. More particularly the invention relates to exchangers in which the membrane and membrane spacer is folded, layered, and sealed in a particular manner. The invention includes a method for manufacturing such multiple opening counter-flow membrane plate exchangers. In addition, it relates to an integrated, modular, and stackable manifold that is formed in a particular manner. The exchangers are useful in heat and water vapor exchangers and in other applications.

BACKGROUND OF THE INVENTION

Heat and water vapor exchangers (also sometimes referred to as humidifiers, enthalpy exchangers, or energy recovery wheels) have been developed for a variety of applications, including building ventilation (HVAC), medical and respiratory applications, gas drying or separation, automobile ventilation, airplane ventilation, and for the humidification of fuel cell reactants for electrical power generation. When constructing various devices intended for the exchange of heat and/or water vapor between two airstreams, it is desirable to have a thin, inexpensive material which removes moisture from one of the air streams and transfers that moisture to the other air stream. In some devices, it is also desirable that heat, as well as moisture be transferred across the thickness of material such that the heat and water vapor are transferred from one stream to the other while the air and contaminants within the air are not permitted to migrate.

Planar plate-type heat and water vapor exchangers use membrane plates that are constructed using discrete pieces of a planar, water-permeable membrane (for example, Nafion®, natural cellulose, sulfonated polymers or other synthetic or natural membranes) supported by a separator material (integrated into the membrane or, alternatively, remains independent) and/or frame. The membrane plates are typically stacked, sealed, and configured to accommodate fluid streams flowing in either cross-flow or counter-flow configurations between alternate plate pairs, so that heat and water vapor is transferred via the membrane, while limiting the cross-over or cross-contamination of the fluid streams.

One well known design for constructing heat exchangers employs a rotating wheel made of an open honeycomb structure. The open passages of the honeycomb are oriented parallel with the axis of the wheel and the wheel is rotated continuously on its axis. When this concept is applied to heat exchange for building ventilation, outside air is directed to pass through one section of the wheel while inside air is directed to pass in the opposite direction through another portion of the wheel. An energy recovery wheel typically exhibits high heat and moisture transfer efficiencies, but has undesirable characteristics including a fast rotating mass inertia (1-3 seconds per revolution), a high cross-contamination rate, high pollutant and odor carryover, a higher outdoor air correction factor than is ideal, a need for an electrical energy supply to power geared drive motors, and a need for frequent maintenance of belts and pulleys. Energy recovery wheel transfer efficiency correlates to the rotational speed of the device; spinning the wheel faster typically increases the energy transfer rate. However, any efficiency gained in this manner is offset by more negative effect of the undesirable characteristics here noted. Thus there is a need for a device that exhibits an energy transfer efficiency at least as great as an energy recovery wheel while minimizing these undesirable characteristics, especially the cross-contamination.

An energy recovery wheel processes large volumes of airflow in a relatively low volume footprint. By contrast, the size of a typical cross-flow and counter-flow plate-type exchanger design increases exponentially as the volume of processed airflow increases. As a plate-type exchanger increases in size, pressure drop across the exchanger also increases. Plate spacing on large plate-type exchangers is generally increased to mitigate pressure drop. The increase in plate spacing typically increases the overall volume of the exchanger relative to its design airflow. A further disadvantage is the incompatibility of existing plate-type exchangers to fit into existing air handling units designed to accommodate the relatively thin depth profiles of energy recovery wheels prohibiting retrofit replacement of a wheel by a typical plate-type exchanger.

Energy recovery wheels are typically customized for different end-use applications. The need for customization increases the end-use cost of the exchangers, material waste during manufacturing, design time, failure-testing costs, and a number of performance verification certifications. Energy recovery wheels require a wide variety of structural support sizes, lengths, and quantities and often competing design tradeoffs including number of segments, wheel depths, motor sizes, belt lengths, and wheel speeds. In some HVAC systems, use of an energy recovery wheel may be prohibited due to the inherent risk of failure of the motor, belts, and seals.

Likewise, plate-type energy exchangers are typically customized for different end-use applications. The number and dimensions of cores are dictated by the end-use application. Manufacturing of plate-type exchangers requires the use of custom machinery, custom molds and various raw material sizes. Plate-type energy exchanger designs utilize a large number of joints and edges that need to be sealed; consequently, the manufacturing of such devices can be labor intensive as well as expensive. The durability of plate-type energy exchangers can be limited, with potential delaminating of the membrane from the frame and failure of the seals, resulting in leaks, poor performance, and cross-over contamination (leakage between streams).

In some heat and water vapor exchanger designs, the many separate membrane plates are replaced by a single membrane core made by folding a continuous strip of membrane in a concertina, zig-zag or accordion fashion, with a series of parallel alternating folds. Similarly, for heat exchangers, a continuous strip of material can be patterned with fold lines and folded along such lines to arrive at a configuration appropriate for heat exchange. By folding the membrane in this way, the number of edges that must be bonded can be greatly reduced. For example, instead of having to bond two edges per layer, it may be necessary only to bond one edge per layer because the other edge is a folded edge. However, the flow configurations that are achievable with concertina-style pleated membrane cores are limited, and there is still typically a need for substantial edge sealing, such as potting edges in a resin material. Another disadvantage is the higher pressure drop as a result of the often smaller size of the entrance and exit areas to the pleated core.

Existing cross-flow cores have theoretical efficiency limitations of approximately 80%, while the efficiency of a counter-flow core can theoretically reach 100%. Some current counterflow plate type arrangements have achieved heat transfer efficiencies equal to or greater than energy recovery wheels, but incur the penalties of a much greater volume, higher pressure drop, and higher cost when compared to a recovery wheel. A broad array of shapes have been proposed in the prior art, including long rectangles, hexagonal profiles, and back-to-back cross flow designs. The existing counter-flow plate designs utilize a greater amount of material than their related cross-flow plate exchanger counterparts. In addition, current counter-flow plate designs generally transfer thermal energy only. Counter-flow heat and moisture plate-type exchangers have been expensive to produce due to inherent difficulty of the plate separation techniques, plate sealing, and inefficient use of materials.

While an energy recovery wheel transfers heat and moisture at nearly equal efficiencies, the existing membrane-type plate-exchangers have substantially reduced moisture transfer rates in comparison to thermal energy transfer. Attempts to increase vapor transmission have employed very expensive and specialized polymeric membranes, and have not seen wide spread practical use. This is partially due to spacer materials and membrane seam bonding that are impermeable to water vapor, effectively reducing the available surface area for water transport. In addition, specialized polymeric membranes transfer water vapor substantially in only one direction, perpendicular to the planar surface. Thus, spacing techniques blocking the effective surface area of one side of the membrane inherently inhibits the vapor transmission on the opposite side of the membrane.

When adapting existing plate-type exchangers for large flow applications, a customized metal manifold system is generally employed. This customized, integrated system nearly doubles the cost of the complete assembly; further isolating it from economically competing with energy recovery wheels. Generally, the free-standing manifold system is assembled in the field requiring a significant amount of additional labor. Standard plate exchangers are often slid into pre-defined grooves resulting in a plurality of exchangers. It is difficult to ensure that the multitude of seals between the manifold system and the plate-type exchangers are properly sealed as this work is conducted on site without the proper testing instrumentation. Cross-flow exchangers employed in a typical manifold arrangement are oriented on a 45 degree angle, further increasing the overall depth of the unit making them incompatible with air handling unit designed for energy recovery wheels.

OBJECTS OF THE INVENTION

It is, therefore, numbered among the objects of the present invention is to provide an improved counter-flow exchanger whose membrane is folded from one continuous sheet (or roll).

Another object of this invention is to provide an improved counter-flow exchanger whose separator material is folded from one continuous corrugated netting sheet (or roll).

A further object of this invention is to provide an improved method of constructing counter-flow exchangers whose membranes and separator materials are formed from continuous sheets.

A further object of this invention is to provide an improved bond between membranes utilizing vibration welding and preferably ultrasonic welding.

A further object of this invention is to provide an improved counter-flow exchanger that is resistant to all forms of corrosion.

A further object of this invention is to provide an improved separator material that allows airflow to pass bidirectionally without obstruction, thereby minimizing pressure drop and allowing for a broader array of geometric configurations.

A further object of this invention is to provide an improved counter-flow exchanger without the need for any potting resin.

A further object of this invention is to provide a modular and stackable manifold that can readily be integrated into counter-flow exchanger allowing for larger airflow quantities.

A further object of this invention is to provide a plate exchanger with integrated manifold that exhibits a smaller depth profile, comparable to that of an energy recovery wheel.

A further object of this invention is to provide an exchanger that is lighter weight and utilizes less material, thus reducing overall manufacturing costs.

A further object of this invention is to provide a plate exchanger that can be easily scaled for larger airflow quantities without necessary adjustment to exchanger depth, membrane width, performance efficiency, pressure drop, or membrane spacer height.

A further object of this invention is to provide a drop-in replacement for existing energy recovery wheels; matching frontal surface dimensions, matching depth dimensions, and matching their straight-through airflow arrangement.

A further object of this invention is to increase the speed at which plate type membrane exchangers are manufactured and to allow for a fully automated manufacturing protocol.

A further object of this invention is to provide an exchanger manifold that is ultrasonically butt-welded from standard plastic sheet stock.

A further object of this invention is to provide an exchanger manifold that acts as a drain pan allowing for a certain condensate holding capacity and allowing for longer operation in subfreezing condensing operation.

A further object of this invention is to provide an exchanger manifold that allows for a wide variety of flow path configurations including straight-through, cross-over, and back-to-back.

A further object of this invention is to provide a simple method of structurally attaching and fluidly sealing one manifold plate exchanger to another manifold plate exchanger, forming a wall.

SUMMARY OF THE INVENTION

The present approach provides a uniquely reverse-folded core that provides a stack or layered array of openings or fluid passageways, and that utilizes folds from a continuous membrane for edge sealing. In preferred embodiments, the multiple opening membrane core is manufactured using one continuous strip, or roll. The continuous membrane strip undergoes a repeated folding process to produce a plurality of layers, incorporating also steps to intermittently join each membrane edge to an adjoining layer membrane edge thereby forming seals. The resultant passageways are configured in alternating counter-flow arrangement.

In particular, a method for making a multiple opening, counter-flow plate type exchanger comprising a plurality of membrane layers by positioning a single continuous membrane strip with a first and second edge and making a 180° reverse fold upon itself to form a second layer overlying the first layer. A plurality of first membrane seals are formed by intermittently joining unsealed first edges of adjoining first and second layers. A plurality of second membrane seals are formed by intermittently joining unsealed second edges of adjoining first and second layers.

The continuous membrane strip is again 180° reverse folded upon itself to form a third layer overlying the second layer. A plurality of third membrane seals are formed by intermittently joining unsealed first edges of adjoining second and third layers. A plurality of fourth membrane seals are formed by intermittently joining unsealed second edges of adjoining second and third layers. The folding and joining steps are repeated to form a multiple opening core with a stack or layered array of passageways between the membrane layers. The number and length of intermittent seals can be varied to give the resultant core a desired overall length while the number of folds can be varied to give core with the desired number of layers.

In embodiments of the present method, adjacent portions of the membrane layers can be joined by various methods including: vibration welding and more specifically ultrasonically welding the edges of the membrane together, applying impulse style thermal bonding, applying adhesive glue, or applying adhesive tape.

Each of the membrane layers in the multiple opening core will have a number of intersections between sealed and unsealed edges of membrane strips (the number of the intersections will depend upon the number of intermittent seals used in the construction). A method for making a multiple opening core can further comprise applying a sealant material at the intersecting sealed and unsealed edges of the membrane layers. For example, the sealing step can comprise potting the layered intersections (edges that are perpendicular to the folds) of the core with a sealant material.

A method for making a multiple opening core can further comprise inserting a separator between at least some of the plurality of membrane layers. Separators can be inserted either during the counter-folding process or into passageways of the core once the core is formed. In some embodiments the separator is used to define a plurality of discrete fluid flow channels within the passageway, for example, to enhance the flow of fluid streams across opposing surfaces of the membrane. Separators can also be used to provide support to the membrane, and/or to provide more uniform spacing of the layers.

The separators can be of various types, including corrugated, biaxially oriented netting of thermoplastic material whose sinusoidal shape defines a plurality of discrete fluid flow channels within the heat and water vapor exchanger. Biaxial orientation "stretches" extruded square mesh in one or both directions under controlled conditions to produce strong, flexible, light weight netting. Netting material is furthermore placed into a sinusoidal pattern through corrugating process. Other potential types of separators for multiple opening counter-flow core include corrugated sheet materials, mesh materials, and molded plastic inserts.

A preferred method for making a multiple opening core can further comprise inserting a continuous strip of separator material between at least some of the plurality of membrane layers during the counter-pleating membrane process. A continuous strip of separator material is cross-pleated, running parallel to the counter-pleated folds at 90° to the membrane strip seals.

The present invention encompasses continuous membrane cores that are obtained or are obtainable using embodiments of the methods described herein.

Multiple opening membrane cores comprise multiple layers of folded membrane that define a stack or layered array of fluid passageways. Each layer comprises an edge portion of at least two layers of membrane joined edge-to-edge to form at least one seam. The seams in adjacent membrane layers of the core are oriented parallel to one another.

Multiple opening cores produced using a continuously folded membrane can be used in a variety of applications, including heat and water vapor exchangers. The cores are particularly suitable for use as cores in energy recovery ventilators (ERV) applications. They can also be used in heat and/or moisture applications, air filter applications, gas dryer applications, flue gas energy recovery applications, sequestering applications, gas/liquid separator applications, automobile outside air treatment applications, airplane outside air treatment applications, and fuel cell applications. Whatever the application, the core is typically disposed within some kind of housing.

An embodiment of a multiple opening, counter-flow plate type exchanger for transferring thermal energy and moisture between a first fluid stream and a second fluid stream, the exchanger comprising: a housing defined by a pair of opposed side walls, opposed top and bottom walls, opposed first and second faces, and opposed first and second partitions. The first face with first plurality of inlet ports is substantially separated from first plurality of outlet ports by said first partition. A substantially parallel opposing second face contains a second plurality of inlet ports substantially separate from second plurality of outlet ports by a second partition. The first inlet ports on first face are directly opposite second inlet ports on second face and first outlet ports on first face are directly opposite second outlet ports on second face. A continuous sheet of thermal energy and moisture transferring membrane is enclosed within the housing, having first and second longitudinally extending edges. The sheet being folded upon itself in opposite directions alternately on the fold regions which extend between first and second faces of the housing and transversely to longitudinally extending edges to define between fold regions a plurality of substantially parallel, mutually spaced sheet portions. Each sheet portion extends through housing and has first and second terminal edge sections located in the regions of first and second surfaces, respectively, and wherein fold regions comprise an upper set of fold regions located contiguous with top housing wall and a lower set of fold regions located contiguous with bottom housing wall. Wherein for substantially each sheet portion which is located between first and second sheet portions which are adjacent thereto, edge sealing means are provided for sealing plurality of inlet and outlet portions of the first edge section thereof to plurality of inlet and outlet portions of the respective first edge sections of the first and second adjacent sheet portions respectively. Edge sealing means provided for sealing plurality of inlet and outlet portions of the second edge section thereof to plurality of inlet and outlet portions of the respective second edge sections of second and first adjacent sheet portions respectively.

Whereby, alternate pairs of adjacent sheet portions define first channels for flow of fluid moving through the exchanger and wherein the other alternate pairs of adjacent sheet portions define second channels for flow of fluid moving through the heat exchanger. Wherein, all first inlets on first face fluidly connect to all second outlets on second face and wherein all second inlets on the second face fluidly connect to all first outlet on the first face.

Exchangers utilizing reverse-folded membranes and separators of the type described herein have enhanced sealing characteristics and reduced construction time. ERV cores comprising multiple opening cores of this type described herein have given superior results in pressurized crossover leakage relative to conventional planar plate-type core designs. ERV cores comprising counter-pleated cores of this type described herein have given superior results in moisture transfer relative to conventional planar plate-type core designs.

Exchangers utilizing reverse-folded membranes and spacers of the type described herein have improved heat and/or moisture transfer efficiencies.

Exchangers utilizing reverse-folded membranes and spacers of the type described herein have reduced material costs and reduced construction time.

Exchangers utilizing multiple opening exchanger and related manifold described herein utilize less depth, less volume, and are overall more compact to fit into existing HVAC equipment.

Exchangers utilizing this folding configuration are advantageous in that they reduce the number of edges that have to be sealed, especially relative to counter-flow plate-type heat and water vapor exchangers where individual pieces of membrane are stacked and have to be sealed along four edges.

A first aspect of the present invention is a method for making a multiple opening, counter-flow plate type exchanger comprising a plurality of membrane layers, including the steps of (a) forming the plate exchanger from a single continuous membrane strip having a first edge and a second edge by positioning a first sheet portion as a first membrane layer; (b) making a 180° reverse first fold of the membrane strip to form a second sheet portion overlying the first sheet portion, the second sheet portion comprising a second membrane layer; (c) forming a plurality of first membrane seals by intermittently joining the first edges of the first and second sheet portions beginning at the first fold then terminating to form a first manifold portion of a plurality of first manifold portions and forming additional the first membrane seals by joining unsealed portions of the first edges beginning a distance from a previous the first manifold portion then terminating to form additional first manifold portions along the first edges, the first manifold portions being defined by the first membrane seals; (d) forming a plurality of second membrane seals by intermittently joining the second edges of the first and second sheet portions beginning a distance from the first fold then terminating to form an initial second manifold portion of a plurality of second manifold portion and forming additional second membrane seals by joining unsealed second edges beginning a distance from the previous second manifold portion then terminating to form additional second manifold portions along the second edges, the second manifold portions being defined by the second membrane seals; (e) making a 180° reverse second fold in the continuous membrane strip to form a third sheet portion overlying the second sheet portion, the third sheet portion comprising a third membrane layer; (f) forming a plurality of third membrane seals by intermittently joining unsealed first edges of the second sheet portion to adjacent first edges of the third sheet portion to form a plurality of third manifold portions along the first edges, the third manifold portions being defined by the third membrane seals; (g) forming plurality of fourth membrane seals by intermittently joining unsealed second edges of the second sheet portion to adjacent second edges of the third sheet portion to form a plurality of fourth manifold portions along the second edges, the fourth manifold portions being defined by the fourth membrane seals; (h) repeating steps (e), (f), (g) thereby forming the continuous-pleated membrane exchanger with a stacked array of passageways between the membrane layers.

Preferably, said step of forming the second manifold portions positions the second manifold portions offset from the first manifold portions and said step of forming the fourth manifold portions positions the fourth manifold portions offset from the third manifold portions, the first and second manifold portions containing a first fluid stream and the third and fourth manifold portions containing a second fluid stream, whereby the first and second fluid streams cris-cross. Preferably, conducting of the first, second, third and fourth forming steps result in all of the first manifold portions fluidly connecting to all of the second manifold portions and all of the third manifold portions fluidly connecting to all the fourth manifold portions. The method further comprises the step of surrounding the continuous-pleated membrane exchanger with a housing which fluidly connects all the first manifold portions, the second manifold portions, the third manifold portions, and the fourth manifold portions.

Preferably, the step of joining of the adjacent edge portions of the continuous membrane strip comprises the step of ultrasonically welding the edge portions. Alternatively, the joining step is performed by applying adhesive tape along the seams. A second alternative involves joining the adjacent edge portions by adhesively bonding the edge portions. The method further includes the step of inserting a separator between at least some of the plurality of membrane layers during the folding process. Preferably, the inserting step is performed after steps (a) and (e) and prior to steps (b) and (f), respectively. The method may include an additional step of forming surface features on at least one surface of each membrane strip. This forming step is performed by an operation selected from a group consisting of forming the surface features integrally in the membrane, molding the membrane after its formation, and embossing the surface feature on the membrane after its formation. Alternatively, the forming step can be selected from a group consisting of laminating and depositing material onto least one surface of the membrane.

A second aspect of the invention is directed to a core for a multiple opening, counter-flow plate type exchanger for transferring thermal energy and moisture between a first fluid stream and a second fluid stream, the core comprising: a) a continuous sheet of thermal energy and moisture transferring membrane, the continuous sheet having first and second longitudinally extending edges, multiple spaced parallel sheet portions defined by folding the continuous sheet alternately upon itself in alternately opposite directions defining an upper set of fold regions and a lower set of fold regions which each extend between first and second faces of the exchanger and transversely to the longitudinally extending edges, each sheet portion having first and second terminal edge sections located in the regions of the first and second faces, respectively, the upper set of fold regions being located contiguous with a top exchanger wall and the lower set of fold regions being located contiguous with a bottom exchanger wall; b) edge sealing means for sealing first lengths of the first terminal edge section of a first intermediate sheet portion to first lengths of the first terminal edge sections of a first adjacent sheet portion to form a first plurality of inlets; c) edge sealing means for sealing second lengths of the first terminal edge section of a first intermediate sheet portion to second lengths of the first terminal edge section of a second adjacent sheet portion to form a first plurality of outlets; d) edge sealing means for sealing lengths of the second terminal edge section of the first intermediate sheet portion to lengths of the first terminal edge section of the second edge of the first adjacent sheet portion to form a second plurality of inlets; e) edge sealing means for sealing lengths of the second terminal edge section of a first intermediate sheet portion to lengths of the second terminal edge sections of a second adjacent sheet portion to form a second plurality of outlets; whereby the first plurality of inlets are connected to the first plurality of outlets to define first manifolds for flow of fluid moving through the exchanger in a first direction and wherein the second plurality of inlets are connected to the second plurality of outlets to form second manifolds for conduction flow of fluid in a second opposite direction through the core of said heat exchanger.

Preferably, a separator is positioned between at least some of the sheet portions and at least one of the first and second adjacent sheet portions. The separator defines a plurality of discrete fluid flow channels within one of the manifolds. It is also preferred that membrane sheet be comprised of a water-permeable material selected from a group consisting of corrugated mesh material, corrugated sheet material, a mesh material, and a molded plastic insert. The edge sealing means is a plurality of ultrasonic weld bonds, each ultrasonic weld bond fluidly sealing an adjacent pair of first lengths at the inlets to each other and an adjacent pair of the second lengths at the outlets to each other. At one and only one of the first and second faces, the terminal edge sections of a pair of mutually sealed terminal edge sections are integral with a respective pair of fold regions and wherein the pair of the plurality of inlets and outlets mutually terminal edge sections terminate at a point spaced inwardly from the respective integral fold regions to define U-shaped, free peripheral terminal edge sections. Preferably, the sealing means may comprise a silicone foam rubber.

A third aspect of the present invention is directed to a multiple opening, counter-flow plate type exchanger for transferring thermal energy and moisture between a first fluid stream and a second fluid stream, the exchanger comprising: a) a core formed from a continuous sheet of thermal energy and moisture transferring membrane, the continuous sheet having first and second longitudinally extending edges, multiple spaced parallel sheet portions defined by folding the continuous sheet alternately upon itself in alternately opposite directions defining an upper set of fold regions and a lower set of fold regions and intermediate sheet sections extending there between, first edge portions of both a first and a second sheet of a first pair of adjacent sheet sections being sealed together to define inlets and second edge portions of the first sheet sections being paired with its opposite adjacent sheet section to form a second pair of adjacent sheet sections, second edge portions of the first and second sheet sections of the second pair of adjacent sheet sections being sealed together to define outlets intermediate the inlets, some of the inlets being connected to some of the outlets to form fluid flow channels; b) a rectangular housing having a top, bottom, front face, and two side walls being constructed of plastic utilizing sonic welding techniques to form seams. The two endmost sheet sections of the core, has a free edge portion which is not sealed to an adjacent sheet section, the free edge portion being sealed to a sidewall of said housing. A region of each of the free edge portions is sealed to one of a top and bottom of the housing and a respective side wall of the housing by means of one of a group consisting of ultrasonic welding, melting using impulse heating, clamping, and silicone foam rubber. The housing preferably includes means for draining any condensate formed in the fluid flow channels therefrom. A lip is provided between the faces and at least a bottom of the housing for containment of condensate formed in the fluid flow channels from the heat exchanger housing. The front and rear faces are comprised of a first housing wall and a second housing wall. A foam sheet is positioned between the first and second housing walls to create a seal held together by mechanical clips. A series of ports is formed in at least some of the top, bottom, front face, rear face, and side walls to permit fluid flow through the exchanger.

Various other features, advantages, and characteristics will become apparent following a reading of the following detailed description.

BRIEF DESCRIPTION OF THE DRAWINGS

The invention itself, together with further objects and advantages thereof, may be better understood in reference to the accompanying drawings in which.

DESCRIPTION OF THE PREFERRED EMBODIMENTS

Figure 1:
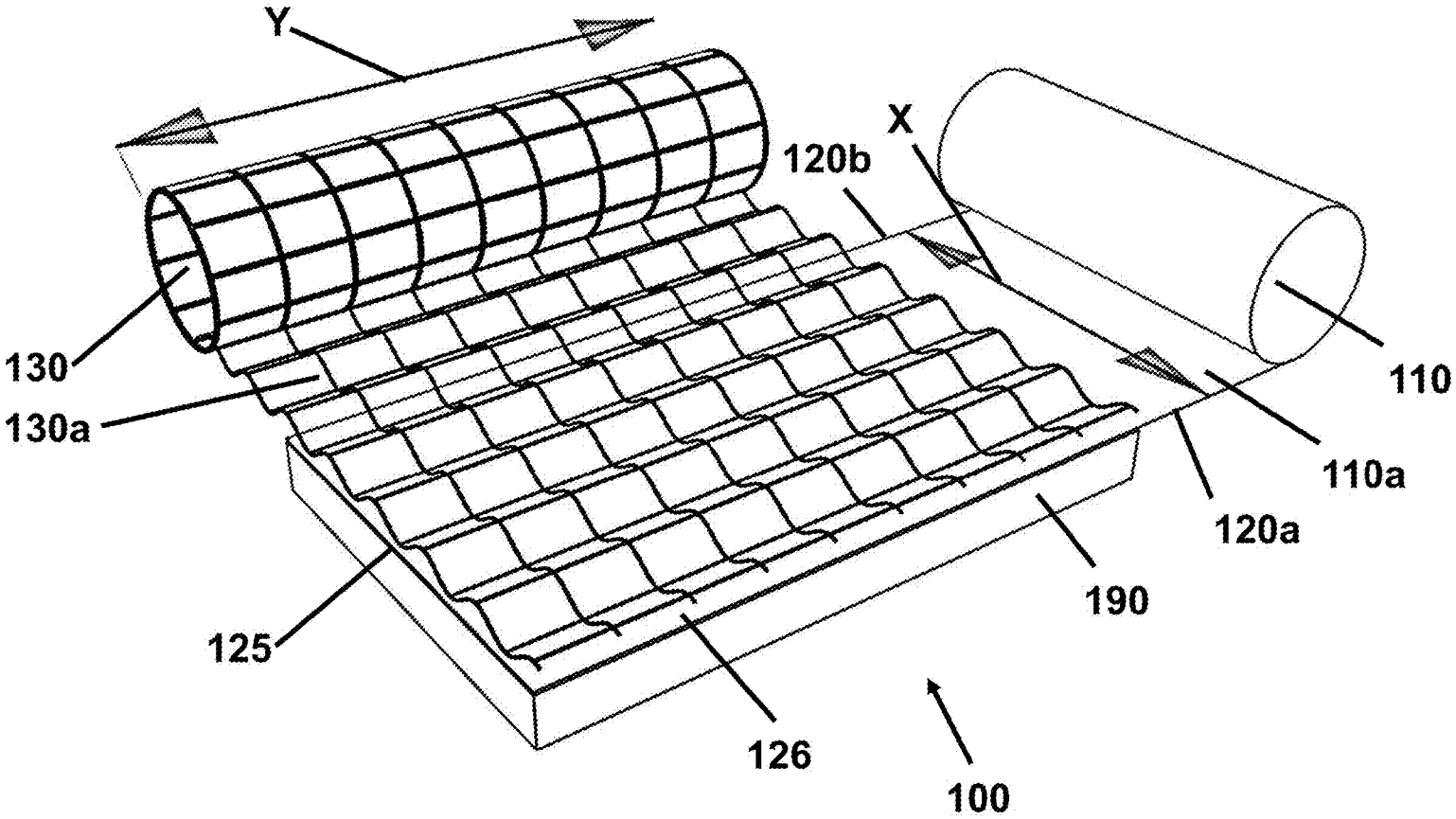
FIG. 1 shows a simplified schematic diagram illustrating a starting position for both the membrane as well as the membrane separator that can be utilized to make a multiple opening, counter-flow plate exchanger.

FIG. 1 shows a simplified schematic diagram illustrating a preferable starting position to make a multiple opening, counter-flow core 100. In FIG. 1, a single continuous membrane strip of membrane 110*a* of width X is drawn in substantially opposite direction from a reel of membrane, 110. Start of membrane 110*a* is produced by 90 angle cut 125. Membrane strip 110*a* is arranged in the same plane on the top surface of a base frame or platform 190 with a first edge 120*a* and a second edge 120*b*. Strip of separator 130*a* is drawn at a 90 angle to strip 110*a* from reel of separator 130 of width Y. Start of separator 130*a* is produced by 90° angle cut 126.

Figure 2A:
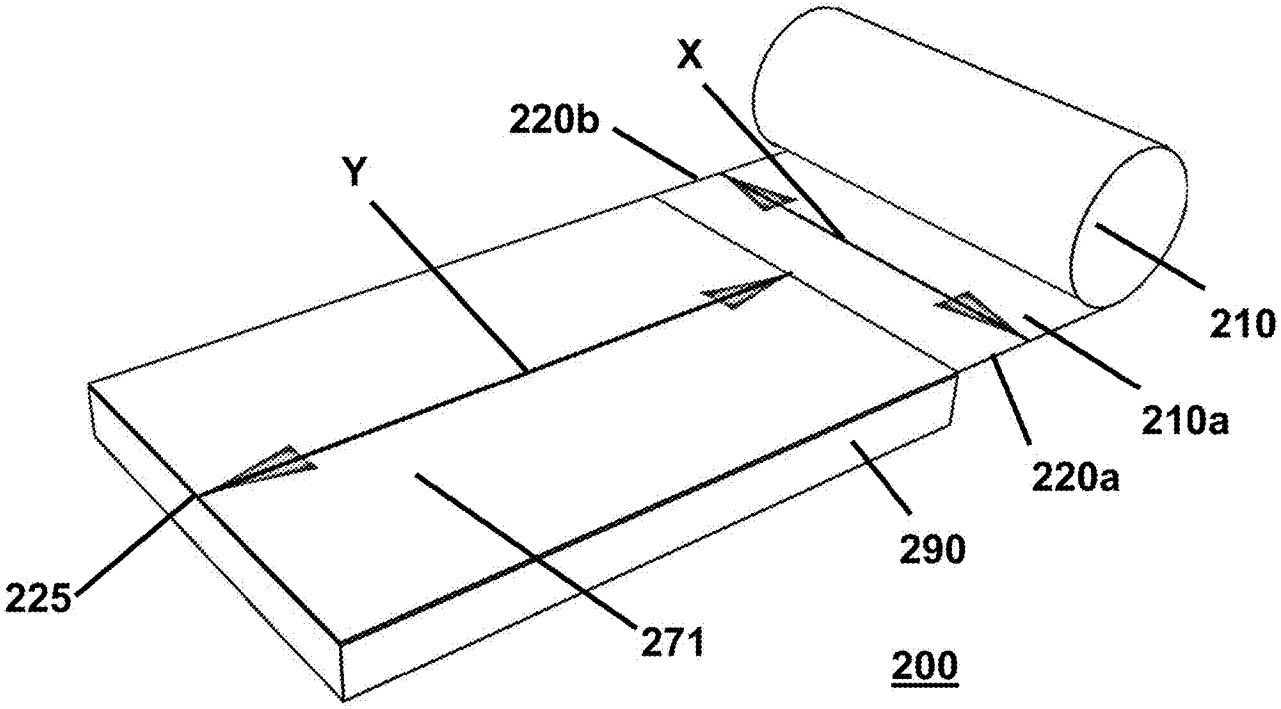
FIGS. 2*a-h* show a series of simplified schematic diagrams illustrating steps in a reverse-folding and multiple port sealing technique utilizing one (1) continuous membrane strip.

FIGS. 2*a-f* show a series of simplified schematic diagrams illustrating steps in a reverse fold technique utilizing a single continuous membrane strip and continuous spacer strip. While the cross insertion of a separator layer has been omitted from the depiction for the sake of simplicity, it will be understood that the insertion of a separator strip 130*a* between each fold is within scope of the invention. In FIG. 2*a*, one strip of membrane 210*a* is drawn in substantially opposite direction from reel of membrane 210 forming a first edge 220*a* and a second edge 220*b*. Start of membrane 210*a* is produced by 90 angle cut 225. Membrane strip 210*a* of width X, is arranged in the same plane on the top surface of a base frame or platform 290 with a length of Y forming a first sheet portion 271.

Figure 2B:
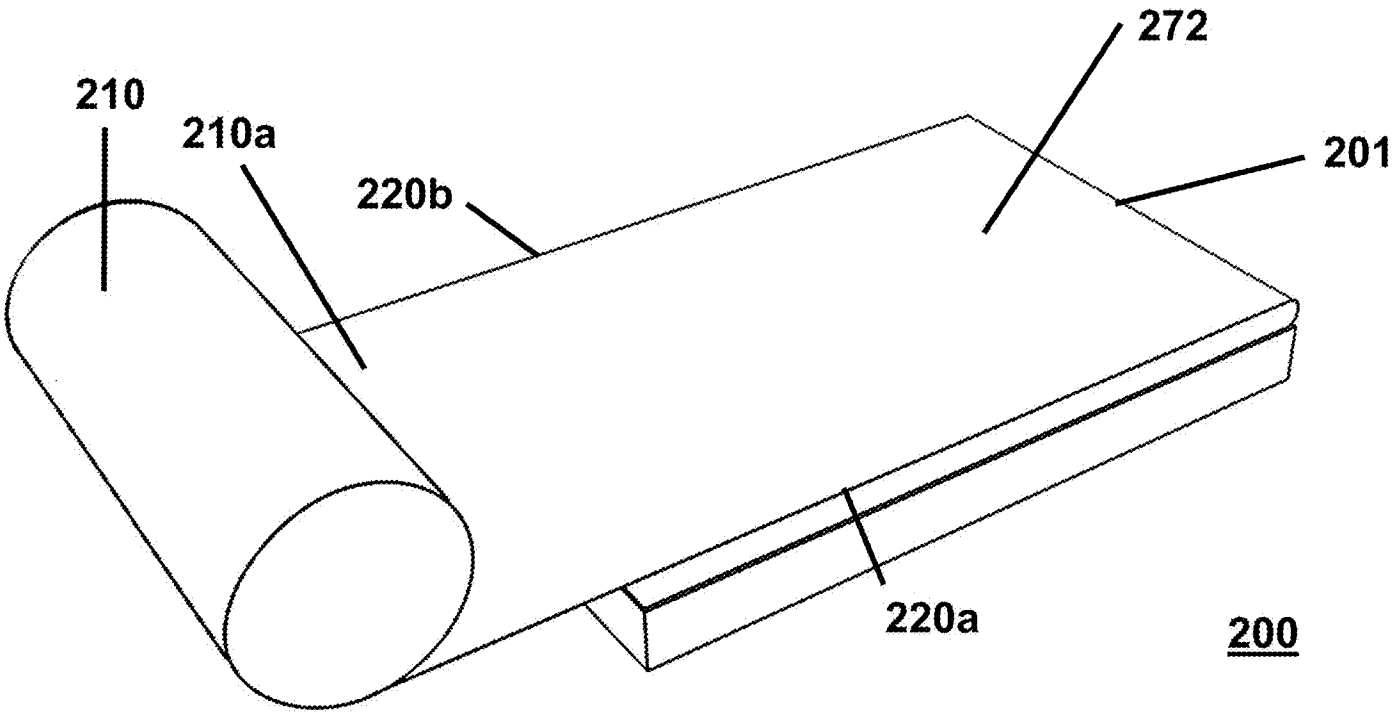

In the next step, shown completed in FIG. 2*b*, membrane strip 210*a* is positioned by making a 180° reverse first fold 201 upon itself to form a second sheet portion 272 overlying first sheet portion 271. In the next step, shown completed in FIG. 2*c*, membrane first edge 220*a* of first sheet portion 271 and second sheet portion 272 is joined beginning at first fold 201 then terminating a distance Z to form a first membrane seal 250*a*. A plurality of additional first membrane seals can be formed by joining unsealed first edges 220*a* beginning a distance W from previous first manifold portion 260 then terminating a distance Z to form additional first membrane seal 250*b*. While the lengths of sealed and unsealed edge portions are illustrated as Z and W respectfully, it will be understood that a variety of different length combinations is within the scope of this invention.

Figure 2C:
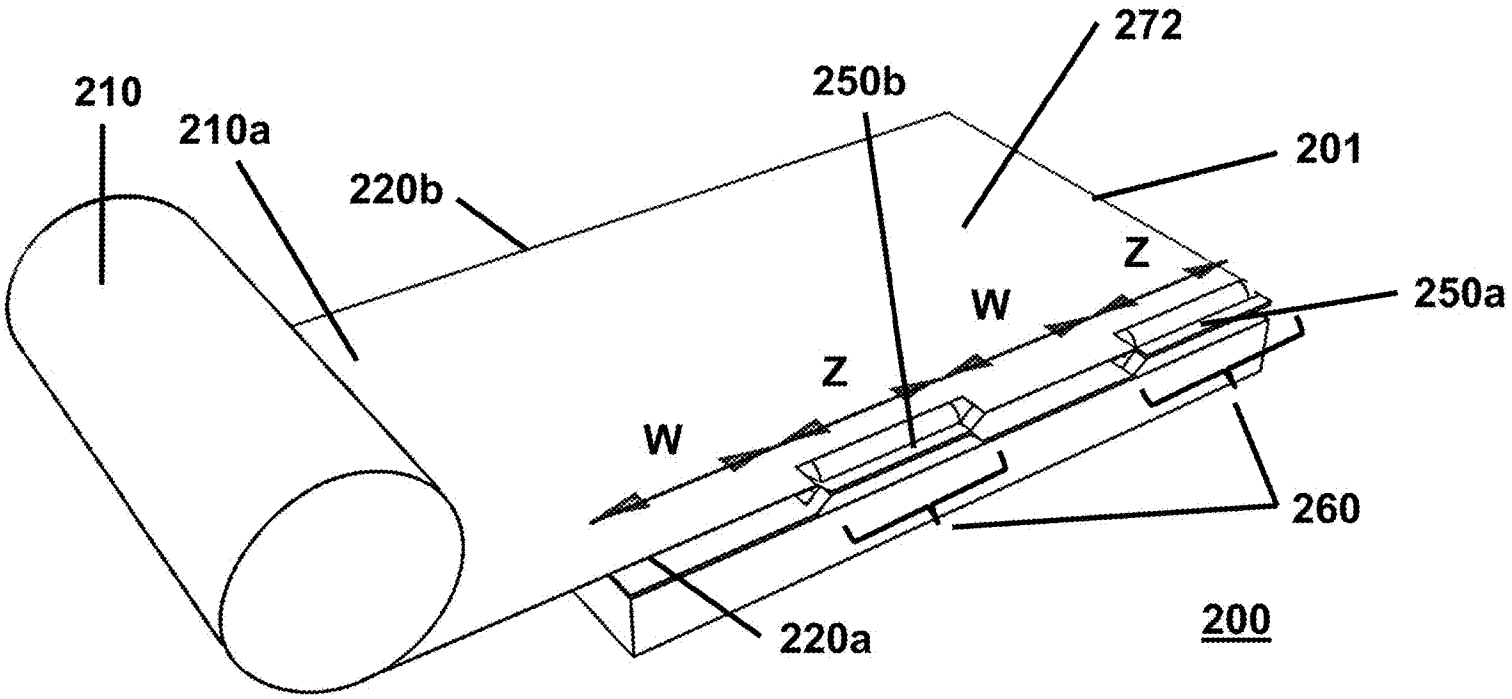
Figure 2D:
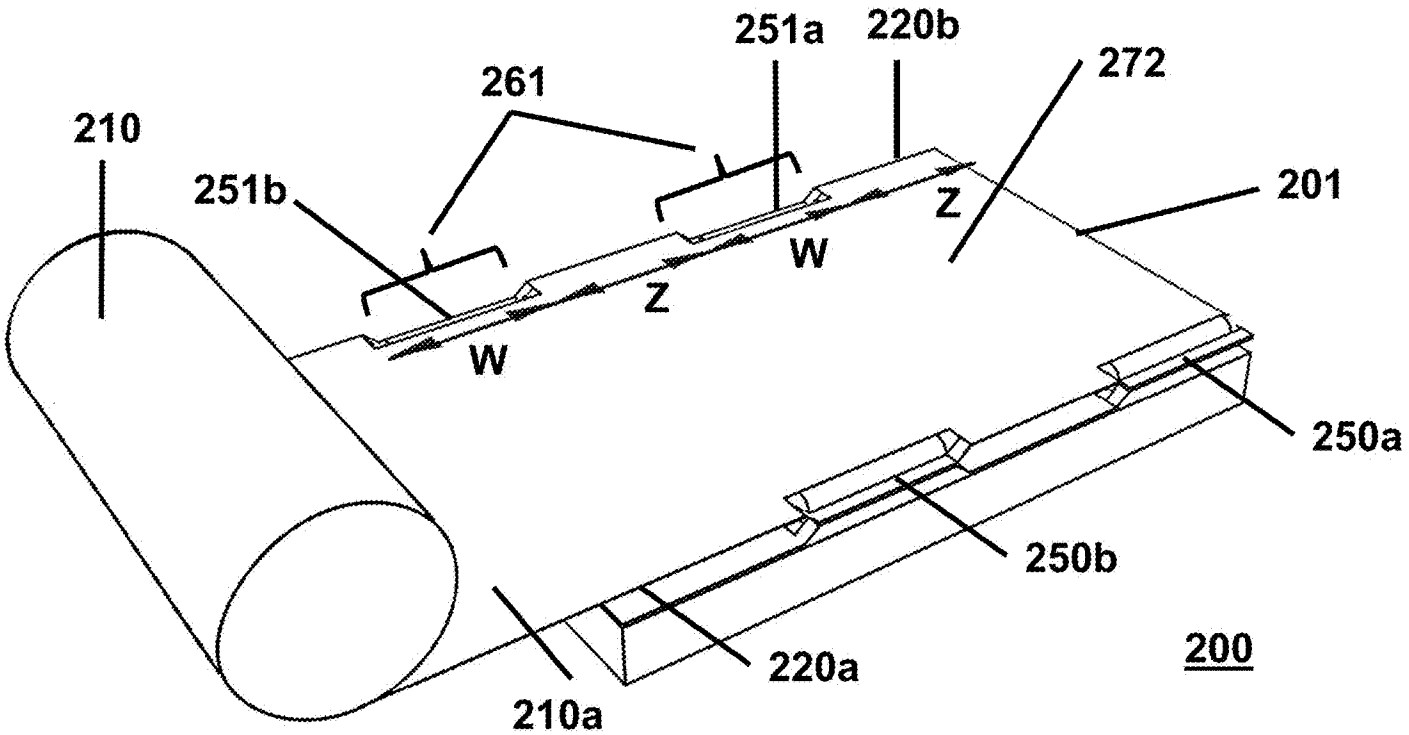

In the next step, shown completed in FIG. 2*d*, membrane second edge 220*b* of first sheet portion 271 and second sheet portion 272 is joined beginning a distance Z from first fold 201 then terminating a distance W to form a second membrane seal 251*a*. A plurality of additional second membrane seals can be formed by joining unsealed second edges 220*b* beginning a distance Z from previous second manifold portion 261 then terminating a distance W to form additional second membrane seal 251*b*. While the relative lengths of sealed and unsealed edge portions are illustrated for simplicity with the same lengths as previously depicted in FIG. 2*c*, it will be understood that a variety of different length combinations is within the scope of this invention.

Figure 2E:
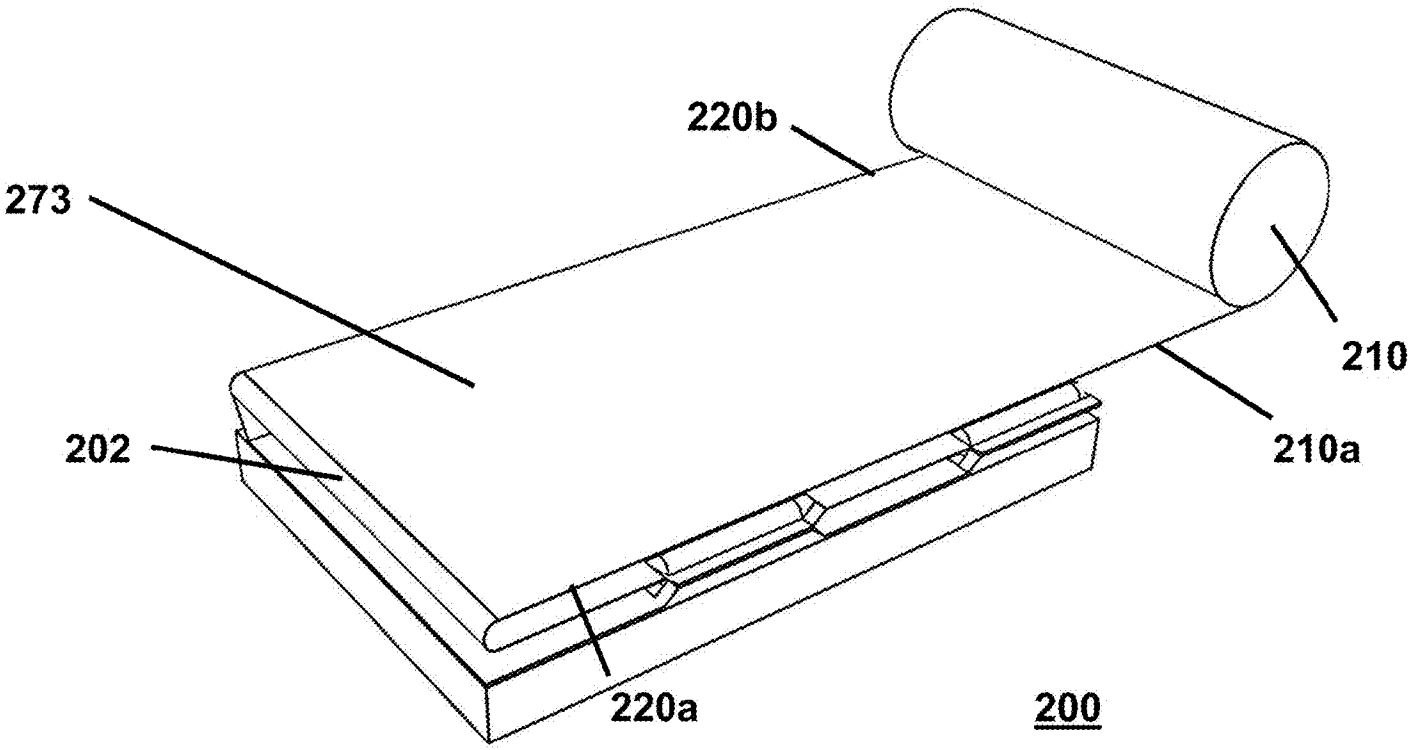
Figure 2F:
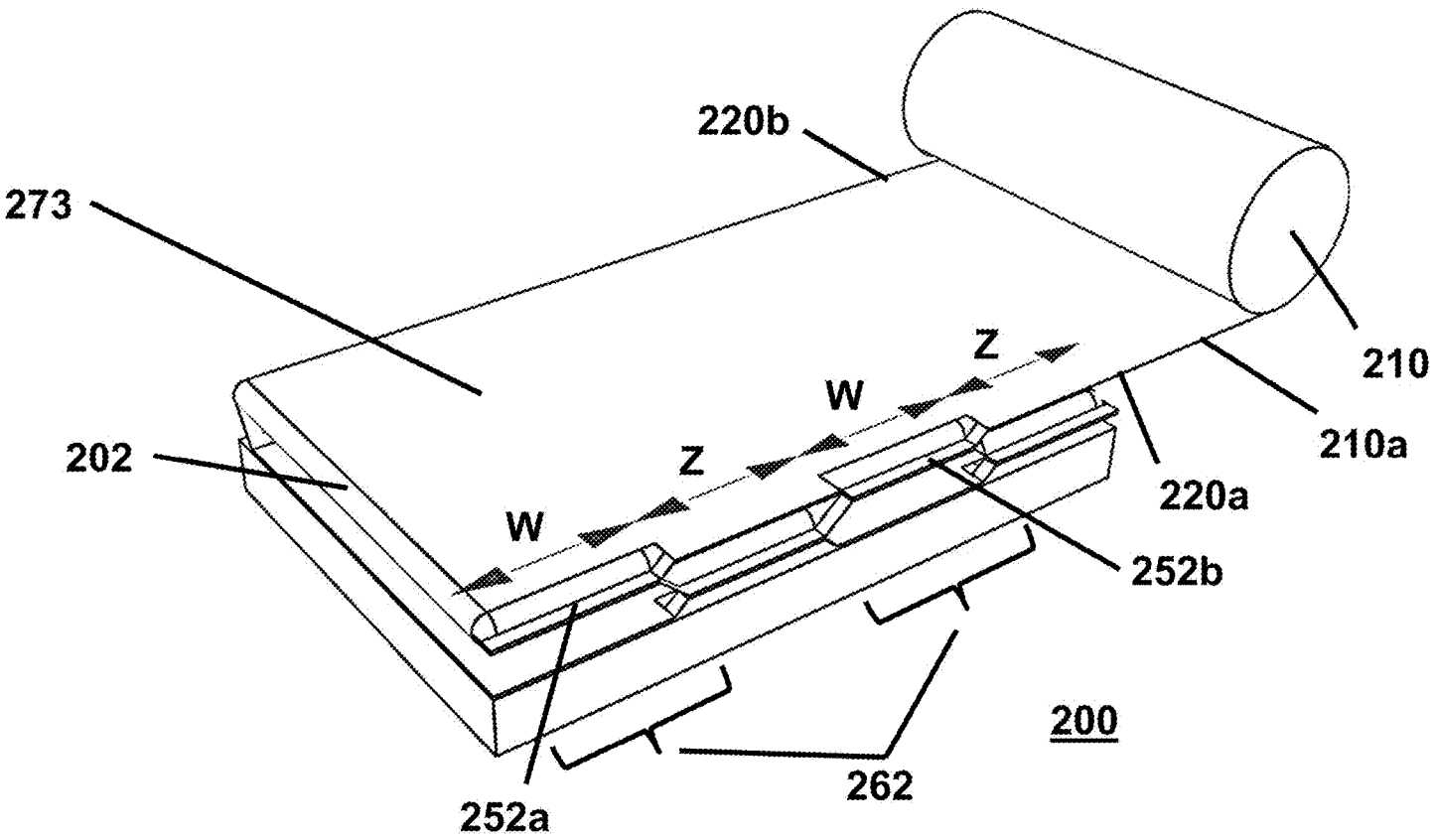

In the next step, shown completed in FIG. 2*e*, membrane strip 210*a* is positioned by making a 180° reverse second fold 202 upon itself to form a third sheet portion 273 overlying second sheet portion 272. In the next step, shown completed in FIG. 2*f*, a plurality of third membrane seals, 252*a* and 252*b*, are formed by joining unsealed first edge 220*a* of second sheet portion 272 to adjacent first edge 220*a* of third sheet portion 273 to form a plurality of third manifold portions 262.

Figure 2G:
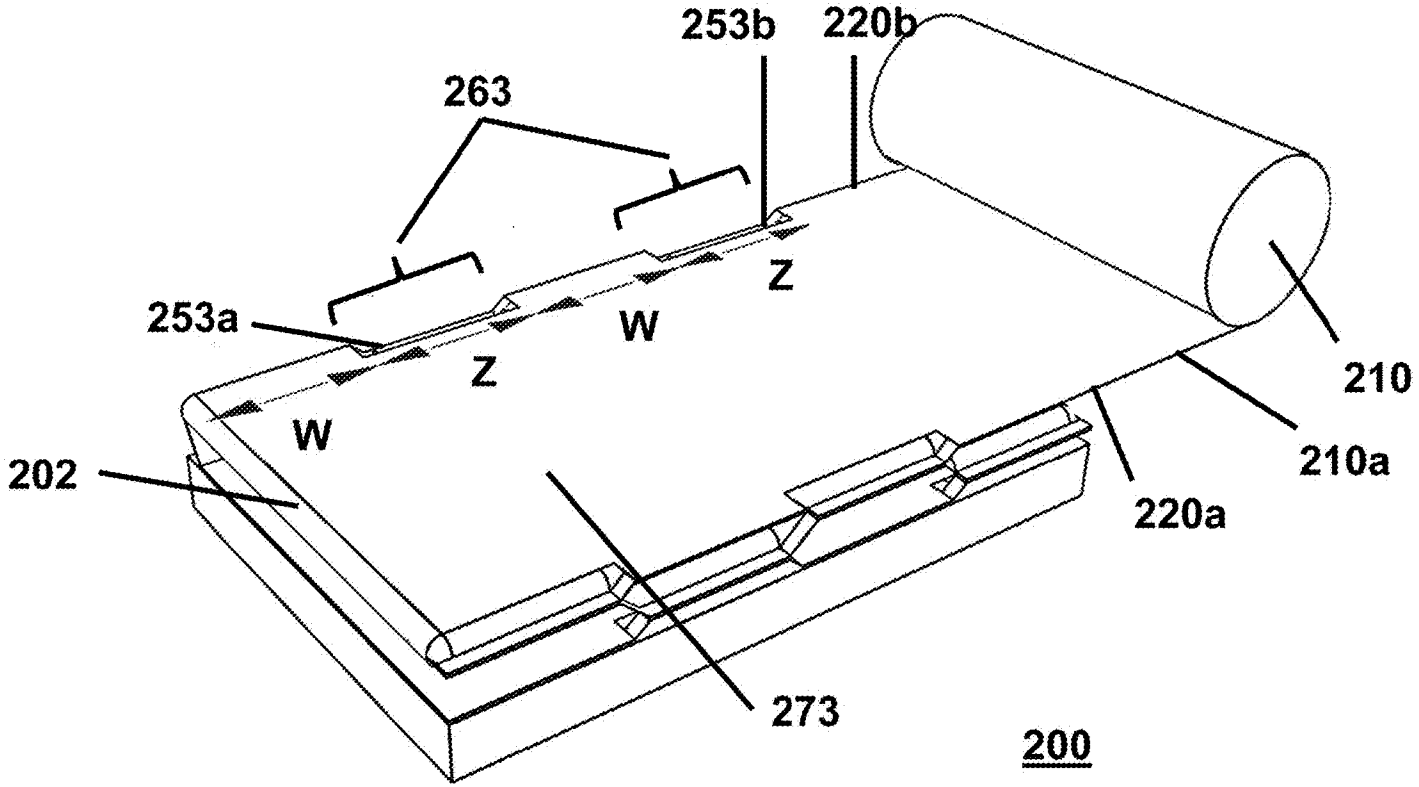

In the next step, shown completed in FIG. 2*g*, a plurality of fourth membrane seals, 253*a* and 253*b*, are formed by joining unsealed second edge 220*b* of second sheet portion 272 to adjacent second edge 220*b* of third sheet portion 273 to form a plurality of third manifold portions 263. The folding and joining process (shown in FIGS. 2*b-g*) is then repeated to give the desired number of layers and openings in membrane core 200.

Figure 2H:
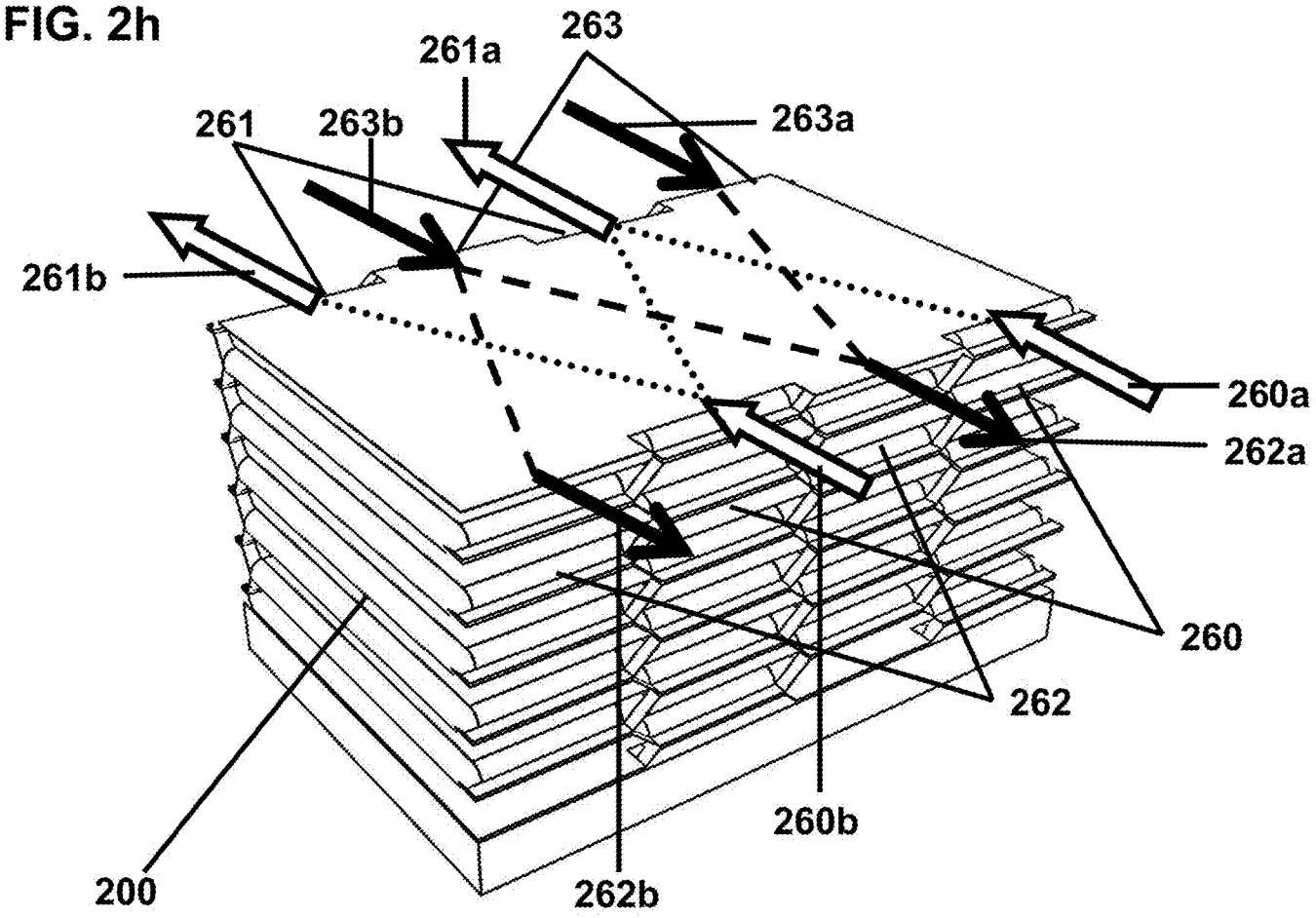

For the last layer of the core, the end membrane strip 210*a* is trimmed at 90 to form the top surface of the core. The resulting reverse-fold core has layered alternating openings or passageways with a plurality of manifold portions on only two out of six faces of the core, thereby creating counter-flow or parallel airflow passageways. FIG. 2*h* shows a first divided fluid supplied to first manifold portion 260 of the core 200 as indicated by arrows 260*a* and 260*b* that will pass through the layered passageways exiting together at the opposite face second manifold portion 261 as indicated by arrows 261*a* and 261*b*. A second divided fluid is supplied to third manifold portion 262 of the core 200 as indicated by arrows 263*a* and 263*b* that will pass through the layered passageways exiting together at the opposite face fourth manifold portion 263 as indicated by arrows 262*a* and 262*b* in FIG. 2*h*. This allows for the counter-flow configuration of two different fluids through alternating layers of the core.

Such cores can be manufactured in a wide variety of lengths and number of membrane strips. The height of the finished core will depend on the number of folded layers, as well as the thickness of the membrane and separator (if any) in each layer. A continuous folding operation could also be envisioned with core size selected and generally cut to any size specification.

Various methods can be used to join the edge seams between two sheet portions of membrane strip 210*a* (for example, 250*a* and 250*b* in FIG. 2*c*). For example, the membrane strips can be vibration welded using ultrasonic frequencies. Using this technique, back pressure would be utilized to create an anvil vibration reflector and then vibration forces applied. Depending on the membrane material, high strength seals have been produced with less than 1/16" of seal depth. In another example, the membrane strips can be thermally joined using impulse type heaters. Using this technique, back pressure would be utilized to create compression and then thermal energy applied. Depending on the membrane material, high strength seals have been produced with less than 1/16" overlap of the membranes. The membrane strips can also be joined together using a suitable adhesive tape, selected depending on the nature of the membrane and/or the end-use application for the core.

Adhesive tape can be placed along the seam contacting each membrane strip and forming a seal. Preferably the tape is wide enough to fold around and adequately cover the seam while accommodating variability in the manufacturing process, without obscuring too much of the membrane surface. Alternatively, a double-sided adhesive or adhesive tape could be employed wherein folding of the adhesive or tape would not be necessary. Alternatively, a mechanical clip can be used in place of an adhesive to join the edges of two sheet portions. Whatever method is used to join the membrane strips along the edge seams, preferably it forms a good seal so that fluids do not pass between layers via a breach or leak in the seam, causing undesirable mixing or cross-contamination of the process streams in the particular end-use application of the core.

In preferred embodiments, a multiple opening core is provided with seals along transitional points between manifold portions (for example between, 260 and 262 in FIG. 2*h*). In one approach these seals are formed with thermally activated glue, caulk, "potting" materials, or foam to form a seal between adjacent sealed, unsealed corners comprising each layer.

The sealant will close off the transitional points created at the intersection between corners of seal produced by the joining process. The seals can be formed using a suitable material, for example a low smoke hot-melt adhesive specifically formulated for air filter applications, silicone based adhesive, or a two-part rubber epoxy material can be used.

In preferred embodiments, a multiple opening core is also provided with seals along the start of membrane strips (for example, 225 FIG. 2*a*) with adjoined housing and along the unsealed edges of the first and last sheet portions with adjoined housing (220*a* along W length in FIG. 2*c*, for example). Various methods can be used to seal the ends of the membrane strips to the housing. In one approach these seals are formed with folded mechanical clips, separate or apart of the housing.

Preferably, with a plastic housing, these seals are formed with by ultrasonically welding the membrane to the plastic housing. The ends and edges of membrane strips could also be sealed to the core housing through suitable single sided adhesive tape, suitable double sided adhesive tape, caulk, two-part epoxy, or other thermally activated adhesive.

Figure 3A:
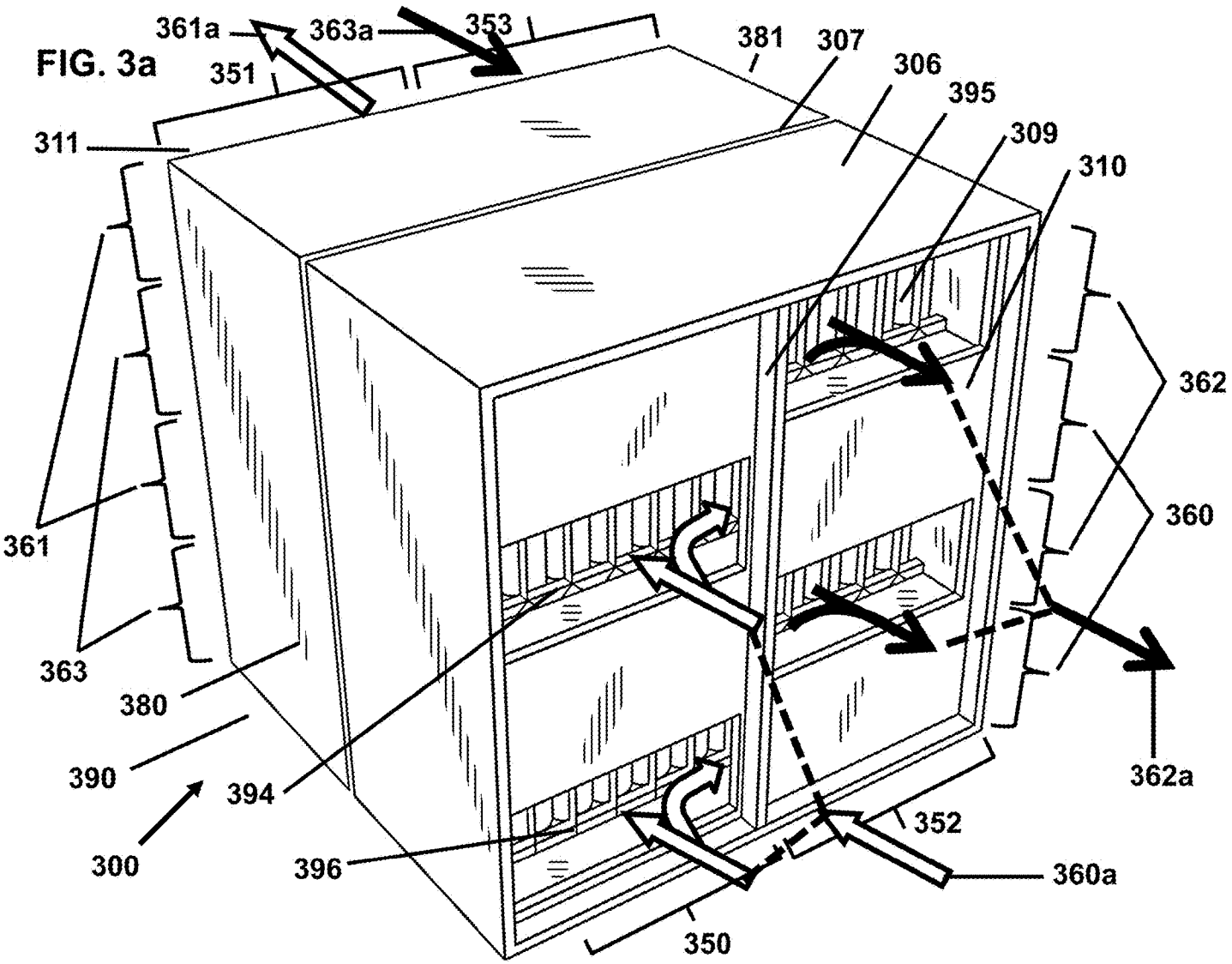
FIGS. 3*a-d* illustrates a multiple opening, reverse-folded exchanger with air stream flows, air stream separation, and integrated housing structure.

FIGS. 3*a-d* show perspective views illustrating a counter-flow exchanger constructed of a single continuous membrane strip. Specifically, FIG. 3*a* illustrates multiple opening, counter-flow exchanger with air stream flows, air stream separation, and reverse fold membrane housing structure. An embodiment of a heat and water vapor exchanger 300, for transferring heat and vapor between first fluid stream 360*a* and second fluid streams 363*a*, the exchanger 300 comprising: a housing 390 defined by a pair of opposed side walls (380, 381), opposed top and bottom walls 306, opposed first face 310 and second face 311. First face 310 divided by first partition 395 into a plurality of inlet ports 350 and a plurality of outlet ports 352.

A substantially parallel opposing second face 311 divided by second partition into a plurality of inlet ports 353 and a plurality of outlet ports 351. Wherein first inlet channels 360 formed by first inlet ports 350 on first face 310 are directly opposite second inlet channels 363 formed by second inlet ports 353 on second face 311 and first outlet channels 362 formed by first outlet ports 352 on first face 310 are directly opposite second outlet channels 361 formed by second outlet ports 351 on second face 311. Preferably, housing 390 is formed by two halves with resultant seam 307 being sealed by any number of ways. A continuous sheet of thermal energy and moisture transferring membrane core 309 enclosed within housing 390, having first and second longitudinally extending edges, said sheet 309 being folded upon itself in opposite directions alternatively on fold regions which extend between first face 310 and second face 311. Longitudinally extending edges define fold regions a plurality of substantially parallel, mutually spaced sheet portions, each sheet portion extending through housing 390 and having first and second terminal edge sections located in the regions of first surface 310 and second surface 311, respectfully. An upper set of fold regions are located contiguous with top housing wall 306 and a lower set of fold regions located contiguous with bottom housing wall. Sealing strip 394 is provided to seal between inlet and outlet channels, attaching continuous membrane 309 to faces. Sealing strip 396 is provided at one of the housing faces, wherein the edge section portions of a pair of mutually sealed edge section portions are integral with a respective pair of fold regions defining a substantially U-shaped free peripheral edge section portions.

Furthermore, first inlet air flow 360*a* entering through first inlet channels 360 fluidly connects to first outlet air flow 361*a* through first outlet channels 361. Second inlet airflow 363*a* entering through second inlet channels 363 fluidly connects to second outlet air flow 362*a* through second outlet channels 362.

Figure 3B:
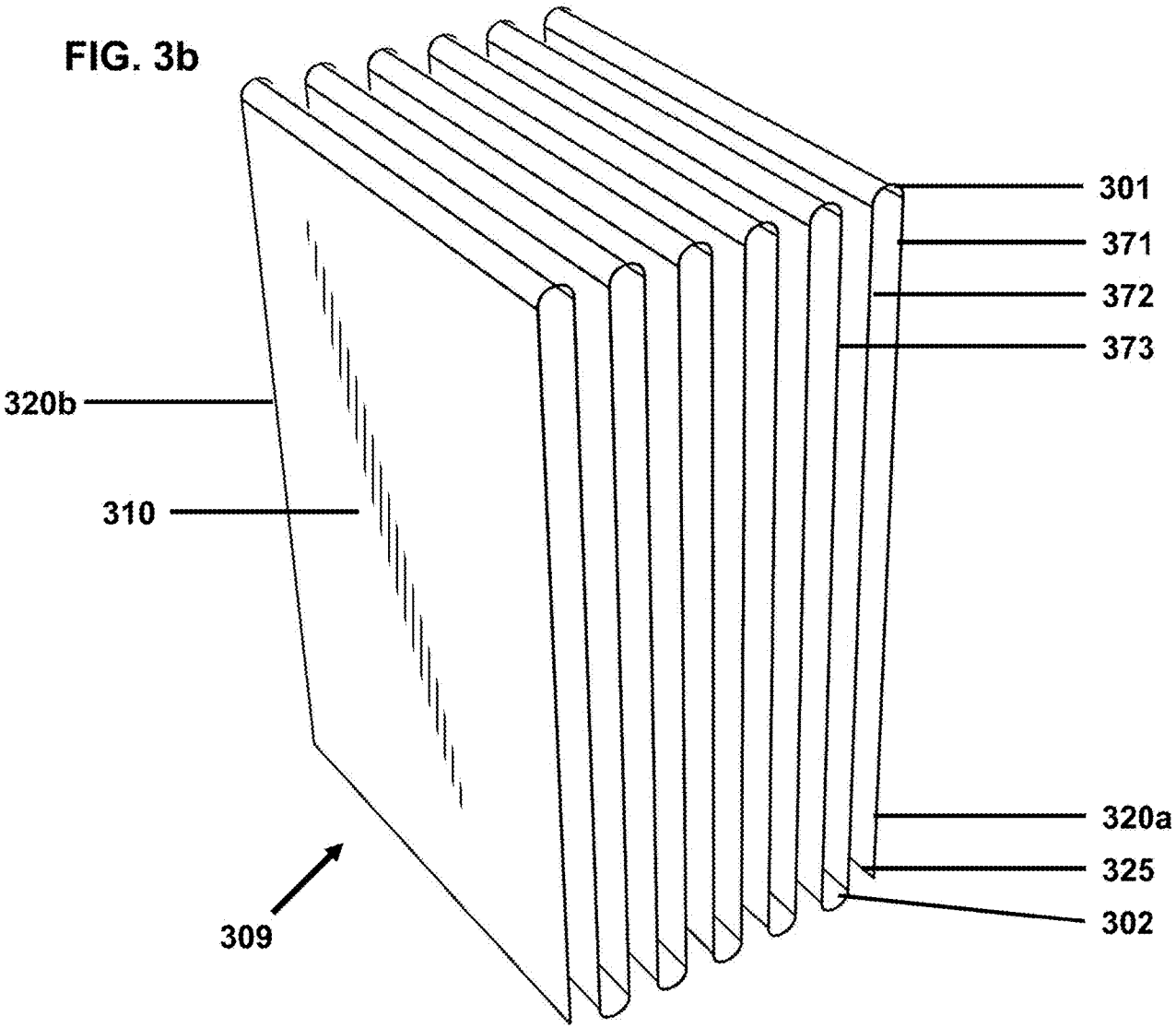

FIG. 3*b* illustrates a continuous sheet of thermal energy and moisture transferring membrane core 309 without the context of the housing structure (for example, 300 in FIG. 3*a*). The core 309 comprises multiple layers of folded, water-permeable membrane 310 with starting edge 325 having first and second longitudinally extending edges 320*a* and 320*b*, respectfully. The sheet has been folded upon itself in opposite directions alternately on fold regions 301 and 302 and transversely to longitudinally extending edges 320*a* and 320*b* to define between the fold regions a plurality of substantially parallel, mutually spaced sheet portions (for example 371, 372, and 373).

Figure 3C:
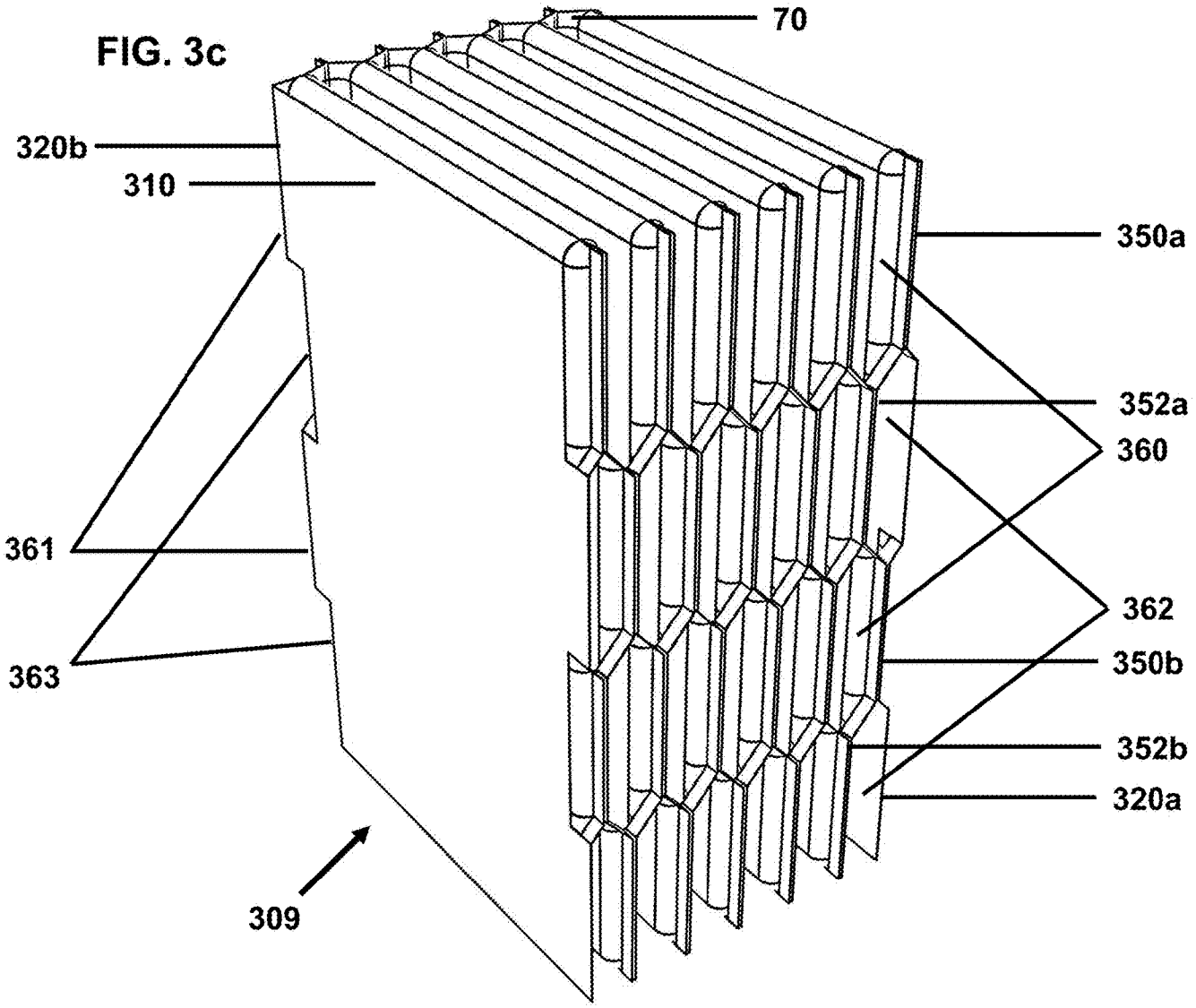

FIG. 3*c* illustrates that for substantially each sheet portion of water-permeable membrane 310 which are adjacent thereto, edge sealing means are provided for sealing plurality of first inlet channels 360 and first outlet channels 362 of the first edge section 320*a* thereof to plurality of inlet and outlet channels of the respective first edge sections of said first and second adjacent sheet portions respectively forming first inlet seals (352*a*, 352*b*) and first outlet seals (350*a*, 350*b*). Means are provided for sealing plurality of second inlet channels 363 and second outlet channels 361 of the second edge section 320*b* thereof to plurality of inlet and outlet channels of the respective second edge sections of said first and second adjacent sheet portions respectively forming first inlet and outlet seals. As seen in FIG. 3*c* on the rear face, a pair of mutually sealed terminal edge sections are integral with a respective pair of fold regions and the the plurality of inlets 363 and outlets 361 mutually terminal edge sections terminate at a point spaced inwardly from the respective integral fold regions to define U-shaped, free peripheral terminal edge sections 70.

Multiple opening counter-flow membrane cores of the type described herein can further comprise separators positioned between the membrane layers, for example, to assist with fluid flow distribution and/or to help maintain separation of the layers. For example, corrugated netting of thermoplastic material, corrugated aluminum inserts, plastic molded inserts, or mesh inserts can be disposed in some of all the passageways between adjacent membrane layers.

Separators may be inserted between the membrane layers after the core is formed or may be inserted during the counter-pleating process, for example between the steps shown in FIG. 2*a* and FIG. 2*b* and then again between FIG. 2*d* and FIG. 2*e* described above.

Figure 3D:
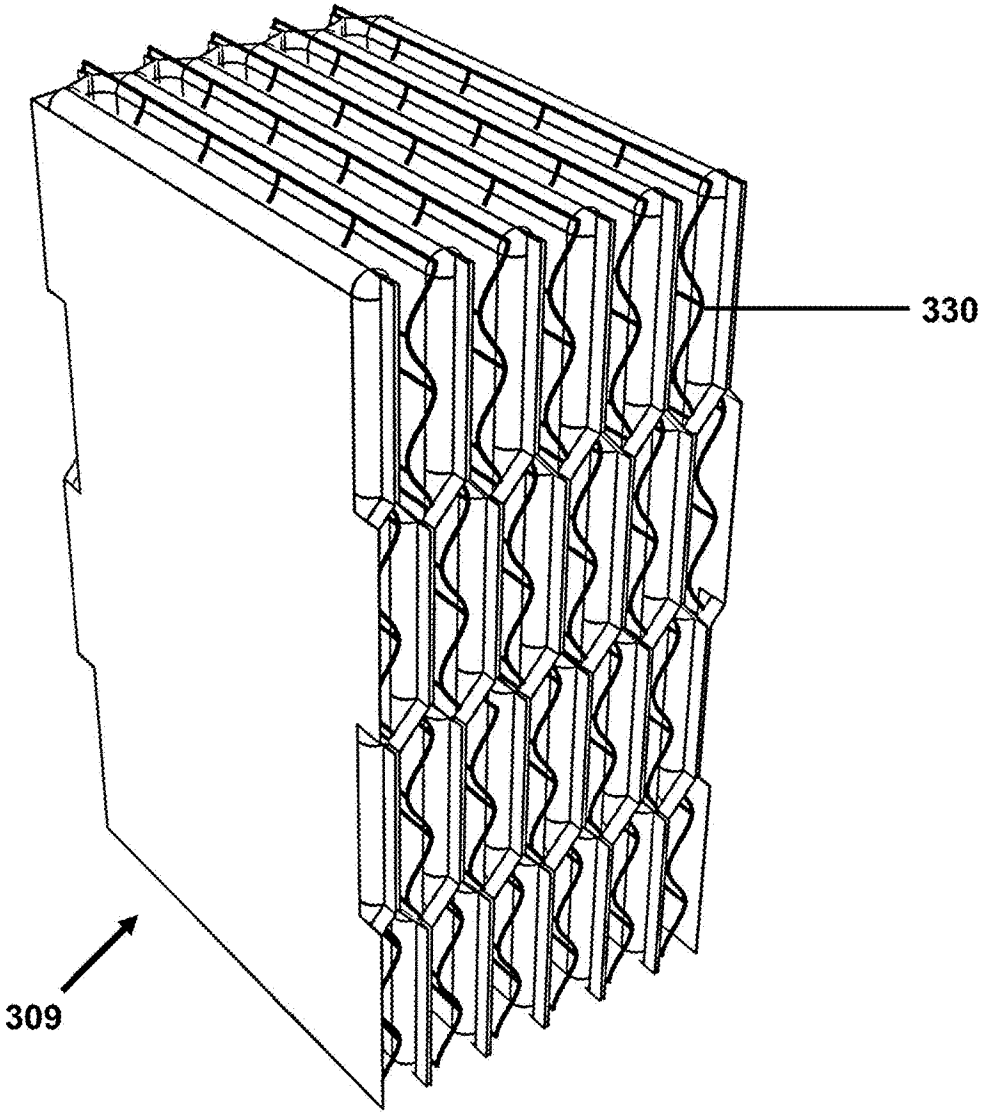

FIG. 3*d* illustrates multiple opening counter-flow membrane core 309 without the context of the housing structure (for example, 390 in FIG. 3*a*), but including reverse-folded, continuous strip separators 330. Separators 330 are preferably woven at a 90 degree orientation to continuous membrane; forming cross-pleated pattern. Preferably, separators 330 are oriented so that the corrugated channels are generally parallel to the inlet and outlet passageway into which they are inserted and oriented parallel to each other, to provide a counter-flow configuration. Furthermore, cross-pleated separators 330 can be locked in place through additional membrane edge sealing. This is advantageous because it also acts to replace "potting" resin on the top and bottom side of counter-pleated core 309. Different separator designs can be used for the alternate layers, or at different locations in the cores—they need not all be the same.

Figure 4A:
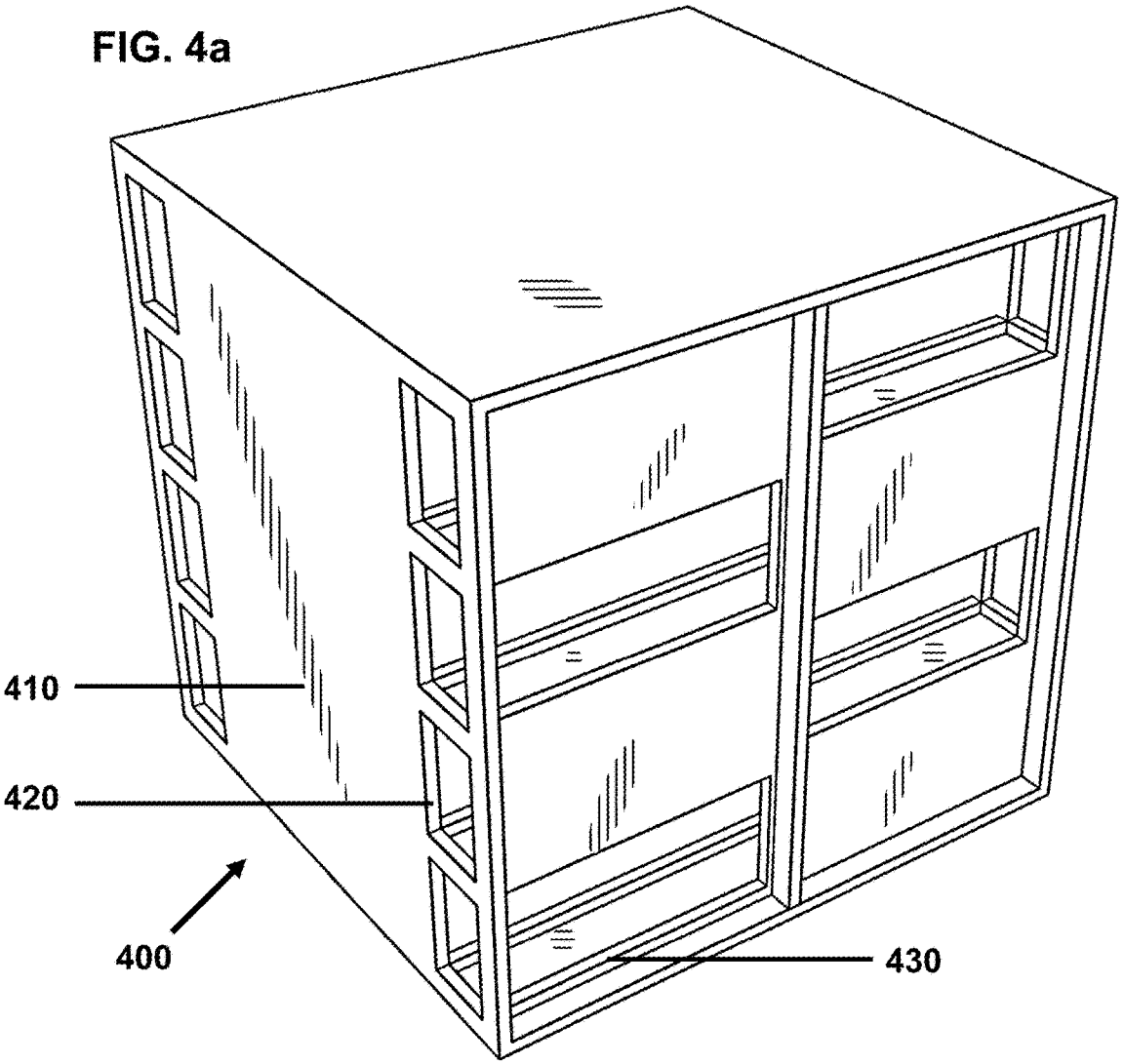
FIGS. 4*a-b* illustrates multiple opening housing with side ports and modular stacking individual exchangers to produce an integrated wall of exchangers.
Figure 4B:
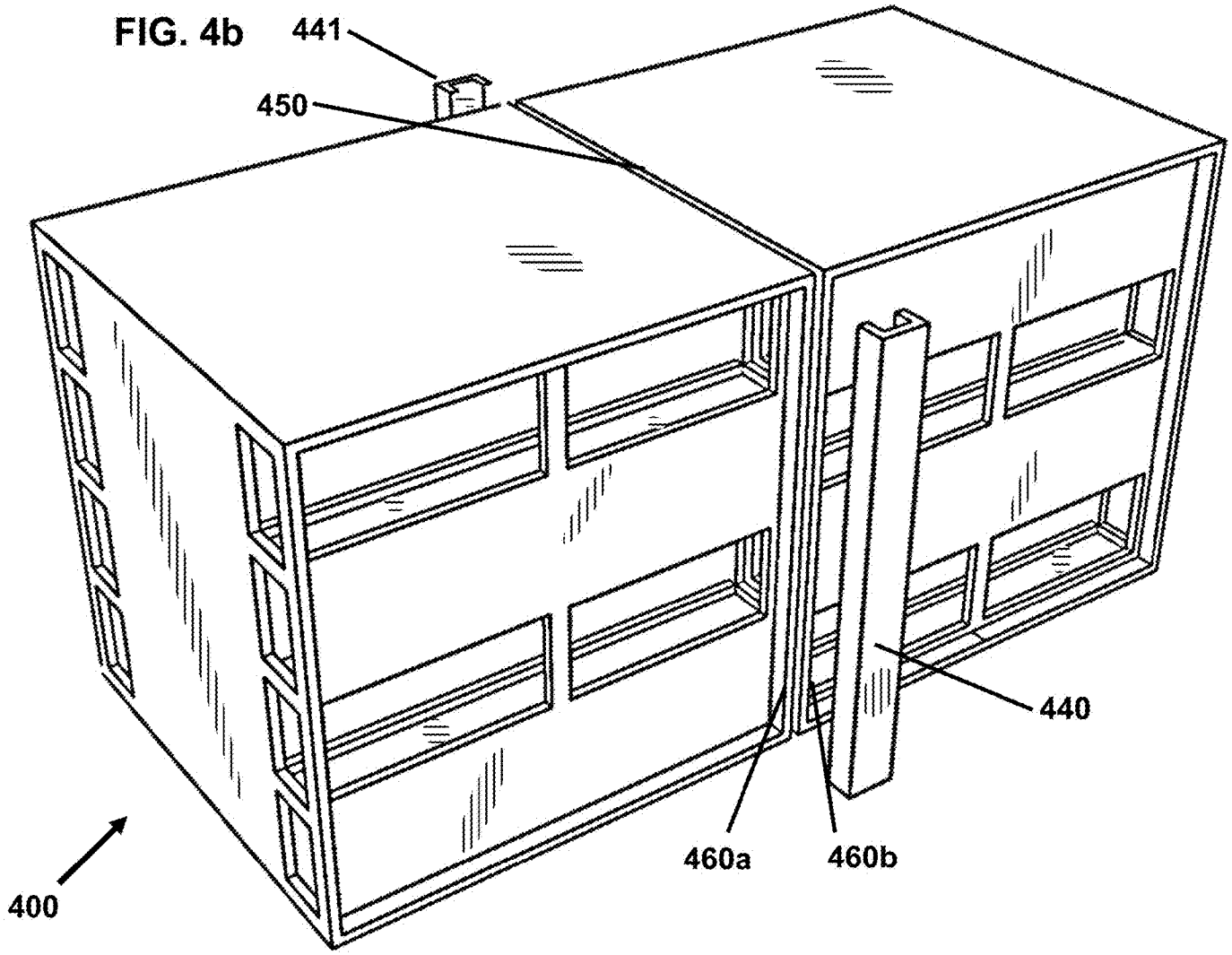

FIGS. 4*a*-*b* show perspective views illustrating a housing 400 for a multiple opening counter-flow membrane plate exchanger. Specifically, FIG. 4*a* illustrates side ports 420 on the side wall 410 allowing for an additional option in brining airflow in and out of the housing 400. FIG. 4*b* is a perspective view that illustrates a multiple module housing 400. Means of connecting one counter-flow exchanger to another is provided by securing a U shaped clip overtop of first exchanger lip 460*a* and second exchanger lip 460*b* forming an airtight seal along interface joint 450. In preferred embodiments, a thin foam sheet is placed in interface joint 450 before U shaped clips 440 and 441 are attached to help facilitate a seal between exchanger surfaces.

Membrane material used in multiple opening counter-flow plate exchangers of the type described herein can be selected to have suitable properties for the particular end-use application. Preferably the membrane is pliable or flexible mechanically such that it can be folded as described herein without splitting. Preferably the membrane will also form and hold a crease when it is folded, rather than tending to unfold and open up again. It is also advantageous that the membrane be of a washable variety so that cores can be completely submerged in cleaning solution. An additional property that is advantageous is the ability to thermally bond membranes using impulse style heating elements or vibration welding techniques.

For energy recovery ventilators or other heat and water vapor exchanger applications, the membrane is water-permeable. In addition, more conventional water-permeable, porous membranes with a thin film coating, that substantially blocks gas flow across the membrane but allows water vapor exchange, can be used. Also porous membranes that contain one or more hydrophilic additives or coatings can be used. Porous membranes with hydrophilic additives or coatings can be used. Porous membranes with hydrophilic additives or coatings have desirable properties for use in heat and water vapor exchangers, and in particular for use in heat and water vapor exchangers with a multiple opening counter-flow membrane core. Preferably, membranes have favorable heat and water vapor transfer properties, are inexpensive, mechanically strong, dimensionally stable, easy to pleat, are bondable to gasket materials such as polyurethane, are resistant to cold climate conditions, and have low permeability to gas cross-over when wet or dry. The membrane should be unaffected by exposure to high levels of condensation (high saturation) and under freeze-thaw conditions.

Asymmetric membranes that have different properties on each surface can be used. If the two asymmetric membrane strips are oriented the same way in the manufacturing process, one set of passageways in the finished counter-pleated core will have different properties than the alternating set of passageways. For example, the membrane strips could be coated or laminated on one side so that the passageways for just one of the two fluid streams are lined by the coating or laminate.

External profiles or features can be added to or incorporated into the membrane to enhance fluid distribution between the layers and/or to help maintain separation of the layers. Ribs or other protrusions or features can be molded, embossed or otherwise formed integrally with the membrane material, or can be added to the membrane afterwards, for example by a deposition or lamination process. Such membranes can be used in counter-pleated cores of the type described herein with or without the use of additional separators.

Multiple opening counter-flow membrane cores of the type described herein can also be formed so that a portion of the core is devoted to heat transfer only while the remaining portion is devoted to both heat and moisture transfer. This arrangement is advantageous in extremely cold climates where the sensible portion of the plate provides a "pre-heating" effect to the incoming fresh air stream and thus reduces possibility of sub-freezing condensation conditions. A "hybrid" counter-pleated core can be manufactured by partially dipping a portion of the core into a solution that will block the porous nature of respective membrane.

A counter-pleating process of the type described in references to FIGS. 2*a-h* can be performed manually or can be partially or fully automated for volume manufacturing. As can be seen from FIGS. 2*a-h*, there is no waste in the manufacturing process associated with counter-pleating technique. All of the membrane is used. Also, in the finished core almost the entire membrane surface is accessible to the fluids that are directed through the core and available to provide the desired fluid and/or heat transport.

The present multiple opening core can be used in various types of heat and water vapor exchangers. For example, as mentioned above, the present multiple opening membrane cores can be used in energy recovery ventilators for transferring heat and water vapor between air streams entering and exiting a building. This is accomplished by flowing the streams on opposite sides of the counter-pleated membrane core. The membrane allows the heat and moisture to transfer from one stream to the other while substantially preventing the air streams from mixing or crossing over.

Other potential applications for the multiple opening cores of the type described herein include, but are not limited to:

1) Fuel cell humidifiers where the multiple opening cores comprises a water-permeable membrane material. For this application the humidifier is configured to effect heat and water vapor transfer from and/to a fuel cell reactant or product stream. For example, it can be used to recycle the heat and water vapor from the exhaust stream of an operating fuel cell transferring latent and sensible energy from one stream to another.
2) Remote energy recovery where an exhaust air stream is located remotely and distinctly from a supply air stream. For this application, two or more independent, multiple opening cores separated by a distance would be joined by a pumped run-around piping system. One of two distinct air passages per core would be replaced with a liquid, affecting an air-to-liquid-to-air transfer. Heat and water vapor would be transferred through pumped liquid to remote and distinctly separate core(s). A multitude of different counter-flow cores are envisioned connecting a multitude of distinctly separator supply and exhaust air streams.
3) Flue gas recapture or filter devices. Flue gas is an exhaust gas that exits to the atmosphere via a flue from a fireplace, oven, furnace, direct-fire burner, boiler, steam generator, power plant, or other such source. Quite often, it refers to the combustion exhaust gas produced at power plants. A multiple opening core can be used to recapture or filter flue gases, water vapor and heat, with a high quality seal thereby limiting toxic gas leakage. Advantages of such configuration would eliminate liquid condensation and produce clean, heated, and humidified supply air to an application.
4) Sequestering (carbon). A multiple opening core can comprise a layer of sequestering material, for example, in alternate membrane layers to transfer, absorb, or trap heat, water vapor, materials, or contaminants.
5) Dryers where a multiple opening core is used in drying of gases by transfer of water from one stream to another through a water-permeable membrane.
6) Gas/liquid separators where the multiple opening core comprises a membrane material that promotes the selective transfer of particular gases or liquids.
7) Gas filtering, where the multiple opening core comprises a membrane material that promotes the selective transfer of particular gas, and can be used to separate that gas from other components.

Other membrane materials (thin sheets or films) besides selectively permeable membrane materials could be pleated to form cores, using the multiple opening technique described herein, for a variety of different applications. For example, pliable metal or foil sheets could be used for heat exchangers, and porous sheet materials could be used for other applications such as filters. In addition, a hybrid sheet where one part is heat transfer only and one part where moisture transfer is allowed is also envisioned.

The preferred orientation of the core will depend upon the particular end-use application. For example, in many applications an orientation with vertically oriented passageways may be preferred (for example, to facilitate drainage); in other applications it may be desirable to have the passageways layered in a vertical stack; or functionally it may not matter how the core is oriented. More than one core can be used in series or in parallel, and multiple cores can otherwise enclosed in a single housing, stacked or side-by-side. Manifolds of various sizes and made out of various materials can be added to facilitate a number of flow configurations.

While particular elements, embodiments, and applications of the present invention have been shown and described, it will be understood that the invention is not limited thereto since modifications can be made by those skilled in the art without departing from the scope of the addended claims, particularly in light of the foregoing teachings.

I claim:

1. A method for making a multiple opening, counter-flow plate type exchanger comprising a plurality of membrane layers, the method comprising the steps of:

(a) forming the plate exchanger from a single continuous membrane strip having a first edge and a second edge by positioning a first sheet portion as a first membrane layer;

(b) making a 180° reverse first fold of the membrane strip to form a second sheet portion overlying the first sheet portion, the second sheet portion comprising a second membrane layer;

(c) forming a plurality of first membrane seals by intermittently joining first edges of the first and second sheet portions beginning at the first fold then terminating to form a first manifold portion of a plurality of first manifold portions and forming additional first membrane seals by joining unsealed portions of the first edges beginning a distance from the previous first manifold portion then terminating to form additional first manifold portions along the first edges, the first manifold portions being defined by the first membrane seals;

(d) forming a plurality of second membrane seals by intermittently joining second edges of the first and second sheet portions beginning a distance from the first fold then terminating to form an initial second manifold portion of a plurality of second manifold portions and forming additional second membrane seals by joining unsealed second edges beginning a distance from the previous second manifold portion then terminating to form additional second manifold portions along the second edges, the second manifold portions being defined by the second membrane seals;

(e) making a 180° reverse second fold in the continuous membrane strip to form a third sheet portion overlying the second sheet portion, the third sheet portion comprising a third membrane layer;

(f) forming a plurality of third membrane seals by intermittently joining unsealed first edges of the second sheet portion to adjacent first edges of the third sheet portion to form a plurality of third manifold portions along the first edges, the third manifold portions being defined by the third membrane seals;

(g) forming plurality of fourth membrane seals by intermittently joining unsealed second edges of the second sheet portion to adjacent second edges of the third sheet portion to form a plurality of fourth manifold portions along the second edges, the fourth manifold portions being defined by the fourth membrane seals;

(h) repeating steps (e), (f), (g) thereby forming the continuous-pleated membrane exchanger with a stacked array of passageways between the membrane layers.

2. The method of claim 1 wherein said step of forming the second manifold portions positions the second manifold portions offset from the first manifold portions and said step of forming the fourth manifold portions positions the fourth manifold portions offset from the third manifold portions, the first and second manifold portions containing a first fluid stream and the third and fourth manifold portions containing a second fluid stream, whereby the first and second fluid streams cris-cross.

3. The method of claim 2 wherein conducting of said first, second, third and fourth forming steps result in all of the first manifold portions fluidly connecting to all the second manifold portions and all of the third manifold portions fluidly connecting to all the fourth manifold portions.

4. The method step of claim 3 further comprising the step of surrounding the continuous-pleated membrane exchanger with a housing which fluidly connects all the first manifold portions, the second manifold portions, the third manifold portions, and the fourth manifold portions.

5. The method of claim 1 wherein joining of adjacent edge portions of the the single continuous membrane strip comprises the step of ultrasonically welding the edge portions.

6. The method of claim 1 wherein joining the adjacent edge portions of the single continuous membrane strips is performed by a method applying adhesive tape along the seams.

7. The method of claim 1 wherein joining adjacent edge portions of the single continuous membrane strip comprises the step of adhesively bonding the edge portions.

8. The method of claim 1 wherein the method further comprises inserting a separator between at least some of the plurality of membrane layers.

9. The method of claim 8 wherein the inserting step is performed during the folding process.

10. The method of claim 9 wherein the inserting step is performed after steps (a) and (e) and prior to steps (b) and (f), respectively.

11. A unitary core for a multiple opening, counter-flow plate type exchanger for transferring thermal energy and moisture between a first fluid stream and a second fluid stream, said core comprising:

a) a single continuous sheet of thermal energy and moisture transferring membrane, said continuous sheet having first and second longitudinally extending edges, multiple spaced parallel sheet portions defined by folding said continuous sheet alternately upon itself in alternately opposite directions defining an upper set of fold regions and a lower set of fold regions which each extend between first and second faces of said exchanger and transversely to said longitudinally extending edges, each said sheet portion having first and second terminal edge sections located in the regions of said first and second faces, respectively, said upper set of fold regions being located contiguous with a top exchanger wall and said lower set of fold regions being located contiguous with a bottom exchanger wall;

b) edge sealing means for sealing a first plurality of first lengths of each said first terminal edge section of a first intermediate sheet portion to a second plurality of first lengths of said first terminal edge section of a second intermediate sheet portion adjacent thereto to form a first plurality of inlets;

c) edge sealing means for sealing a first plurality of second lengths of each said same first terminal edge section of a first intermediate sheet portion to a second plurality of second lengths of said same first terminal edge section of each said second intermediate sheet portion to form a second plurality of inlets below said first plurality of inlets;

d) edge sealing means for sealing a first plurality of third lengths of each said first terminal edge section of said first intermediate sheet portion to a second plurality of third lengths of said first terminal edge section of each of a third intermediate sheet portion adjacent thereto located on an opposite side of said first intermediate sheet portion than said second intermediate adjacent sheet portion to form a first plurality of outlets, said first and second plurality of third lengths lying intermediate said first and second plurality of first lengths;

e) edge sealing means for sealing a first plurality of fourth lengths of each said same first terminal edge section of said first intermediate sheet portion to a second plurality of fourth lengths of each said first terminal edge section of said third intermediate sheet portion located on said opposite side of said first intermediate sheet portion than said second intermediate sheet portion to form a second plurality of outlets below said first plurality of outlets;

f) edge sealing means for sealing a first plurality of first lengths of each said second terminal edge section of said first intermediate sheet portion to a first plurality of first lengths of each said second terminal edge section of said second intermediate sheet portion to form a third plurality of outlets along an opposite side of said core from said first and second pluralities of inlets;

g) edge sealing means for sealing a first plurality of second lengths of each said second terminal edge section of said first intermediate sheet portion to a first plurality of second lengths of each said second terminal edge section of said second intermediate sheet portion to form a fourth plurality of outlets along an opposite side of said core from said first and second pluralities of inlets below said third plurality of outlets;

h) edge sealing means for sealing a first plurality of third lengths of each said second terminal edge section of said first intermediate sheet portion to a first plurality of third lengths of each said second terminal edge sections of said third intermediate sheet portion to form a third plurality of inlets along an opposite side of said core from said first and second pluralities of outlets, said first and second plurality of third lengths lying intermediate said first and second plurality of second lengths;

i) edge sealing means for sealing a first plurality of fourth lengths of each said second terminal edge section of said first intermediate sheet portion to a first plurality of fourth lengths of each said second terminal edge sections of said third intermediate sheet portion to form a fourth plurality of inlets below said third plurality of inlets;

whereby said first plurality of inlets are fluidically connected to said third plurality of outlets to define first manifolds for flow of fluid moving through said exchanger in a first direction and said second plurality of inlets are fluidically connected to said fourth plurality of outlets to define second manifolds for flow of fluid moving through said exchanger in said first direction and wherein said third plurality of inlets are fluidically connected to said first plurality of outlets to form third manifolds for conducting flow of fluid in a second opposite direction through said core of said heat exchanger, and said fourth plurality of inlets are fluidically connected to said second plurality of outlets to form fourth manifolds for conducting flow of fluid in said second opposite direction.

12. The core of claim 11 further comprising a separator positioned between at least some of said sheet portions and at least one of said first and second adjacent intermediate sheet portions.

13. The core of claim 12 wherein each said separator defines a plurality of discrete fluid flow channels within one of said manifolds.

14. The core of claim 13 wherein said membrane sheet is comprised of a water-permeable material selected from a group consisting of corrugated mesh material, corrugated sheet material, a mesh material, and a molded plastic insert.

15. The exchanger of claim 11 wherein all of said inlets formed along said first terminal edge section fluidically communicate with all of said outlets formed along said second terminal edge section.

16. The exchanger of claim 15 wherein all of said inlets formed along said second terminal edge section fluidically communicate with all said outlets formed along said first terminal edge section.

17. A multiple opening, counter-flow plate type exchanger for transferring thermal energy and moisture between a first fluid stream and a second fluid stream, the exchanger comprising:

a) an unitary core formed from a single continuous sheet of thermal energy and moisture transferring membrane, said continuous sheet having first and second longitudinally extending edges, multiple spaced parallel sheet portions defined by folding said continuous sheet alternately upon itself in alternately opposite directions defining an upper set of fold regions and a lower set of fold regions and intermediate sheet sections extending there between, each said intermediate sheet section having a first terminal edge section on a first side and a second terminal edge section on a second opposite side;

b) edge sealing means for sealing a first plurality of first lengths of each said first terminal edge section of a first intermediate sheet portion to a second plurality of first lengths of said first terminal edge section of a second intermediate sheet portion adjacent thereto to form a first plurality of inlets;

c) edge sealing means for sealing a first plurality of second lengths of each said same first terminal edge section of a first intermediate sheet portion to a second plurality of second lengths of said same first terminal edge section of each said second intermediate sheet portion to form a second plurality of inlets below said first plurality of inlets;

d) edge sealing means for sealing a first plurality of third lengths of each said first terminal edge section of said first intermediate sheet portion to a second plurality of third lengths of said first terminal edge section of each of a third intermediate sheet portion adjacent thereto located on an opposite side of said first intermediate sheet portion than said second intermediate sheet portion to form a first plurality of outlets said first and second plurality of third lengths lying intermediate said first and second plurality of first lengths;

e) edge sealing means for sealing a first plurality of fourth lengths of each said same first terminal edge section of said first intermediate sheet portion to a second plurality of fourth lengths of each said first terminal edge section of said third intermediate sheet portion located on said opposite side of said first intermediate sheet portion than said second intermediate sheet portion to form a second plurality of outlets below said first plurality of outlets;

f) edge sealing means for sealing a first plurality of first lengths of each said second terminal edge section of said first intermediate sheet portion to a second plurality of first lengths of each said second terminal edge section of said second intermediate sheet portion to form a third plurality of outlets along an opposite side of said core from said first and second pluralities of inlets;

g) edge sealing means for sealing a first plurality of second lengths of each said second terminal edge section of said first intermediate sheet portion to a second plurality of second lengths of each said second terminal edge section of said second intermediate sheet portion to form a fourth plurality of outlets along an opposite side of said core from said first and second pluralities of inlets below said third plurality of outlets;

h) edge sealing means for sealing a first plurality of third lengths of each said second terminal edge section of said first intermediate sheet portion to a second plurality of third lengths of each said second terminal edge sections of said third intermediate sheet portion to form a third plurality of inlets along an opposite side of said core from said first and second pluralities of outlets said first and second plurality of third lengths lying intermediate said first and second plurality of first lengths;

i) edge sealing means for sealing fourth lengths of each said second terminal edge section of said first intermediate sheet portion to fourth lengths of each said second terminal edge sections of said third intermediate sheet portion to form a fourth plurality of inlets below said third plurality of inlets;

j) a polygonal housing having a top, bottom, front face, rear face, and two side walls being constructed of plastic utilizing sonic welding techniques to form seams.

18. The exchanger of claim 17 wherein each of two endmost sheet sections of said core, has a free edge portion which is not sealed to an adjacent sheet section, said free edge portion being sealed to a sidewall of said housing.

19. The exchanger of claim 18 wherein a region of each of said free edge portions is sealed to one of a top and bottom of said housing and a respective side wall of said housing by means of one of a group consisting of ultrasonic welding, melting using impulse heating, clamping, and silicone foam rubber.

20. The exchanger of claim 17 further including a lip between said faces and at least a bottom of said housing for containment of condensate formed in said fluid flow channels from said heat exchanger housing.

21. The exchanger of claim 20 further comprising a foam sheet positioned between said two side walls to create a seal held together by mechanical clips.

22. The exchanger of claim 20 further comprising a series of ports formed in at least some of said top, bottom, front face, rear face, and side walls to permit fluid flow through said exchanger.

23. The exchanger of claim 17 each of said front and rear faces is comprised of a first housing wall and a second housing wall.

24. The exchanger of claim 17 where all of said inlets formed along said first terminal edge section fluidically communicate with all said outlets formed along said second terminal edge section.

25. The exchanger of claim 24 wherein all of said inlets formed along said second terminal edge section fluidically communicate with all said outlets formed along said first terminal edge section.

* * * * *